US008676094B2

(12) United States Patent
Nakajima et al.

(10) Patent No.: US 8,676,094 B2
(45) Date of Patent: Mar. 18, 2014

(54) DEVELOPING DEVICE, VISIBLE IMAGE FORMING DEVICE, AND IMAGE FORMING APPARATUS

(75) Inventors: Yoshitaka Nakajima, Kanagawa (JP); Shigeru Inaba, Kanagawa (JP); Shota Oba, Kanagawa (JP); Takashi Ochi, Kanagawa (JP); Akihisa Maruyama, Kanagawa (JP); Toshihiro Kanematsu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 183 days.

(21) Appl. No.: 13/298,976

(22) Filed: Nov. 17, 2011

(65) Prior Publication Data

US 2012/0230737 A1 Sep. 13, 2012

(30) Foreign Application Priority Data

Mar. 8, 2011 (JP) ..... 2011-050780

(51) Int. Cl.
*G03G 15/08* (2006.01)

(52) U.S. Cl.
USPC ..... 399/254

(58) Field of Classification Search
USPC ..... 399/254
See application file for complete search history.

(56) References Cited

U.S. PATENT DOCUMENTS

| | | | | |
|---|---|---|---|---|
| 6,259,876 | B1 * | 7/2001 | Fukuda et al. | 399/254 |
| 6,438,344 | B1 * | 8/2002 | Fujimoto | 399/254 |
| 2010/0158573 | A1 * | 6/2010 | Sheen | 399/254 |
| 2010/0215401 | A1 * | 8/2010 | Fujiwara et al. | 399/119 |
| 2011/0008073 | A1 * | 1/2011 | Kudo et al. | 399/254 |
| 2011/0274468 | A1 * | 11/2011 | Itagaki et al. | 399/254 |

FOREIGN PATENT DOCUMENTS

| | | | |
|---|---|---|---|
| JP | 2001-281997 | A | 10/2001 |
| JP | 2002-258605 | A | 9/2002 |
| JP | 2005-208340 | A | 8/2005 |
| JP | 2007-079335 | A | 3/2007 |
| JP | 2008-129128 | A | 6/2008 |
| JP | 2009-175768 | A | 8/2009 |

* cited by examiner

*Primary Examiner* — G. M. Hyder
(74) *Attorney, Agent, or Firm* — Sughrue Mion, PLLC

(57) ABSTRACT

A developing device includes a developer container; a developer holding body including a magnet member and a substantially cylindrical member; a transport member including a rotating shaft and a substantially spiral transport blade; a layer-thickness regulating member; and an interrupting member that is arranged between the developer holding body and the transport member, that intersects with a first virtual plane passing through a facing position between the regulating member and the developer holding body and being adjacent to a rotation locus of a radial-direction outer edge of the transport blade at a position at which a speed in a circumferential direction of the transport blade has a speed component toward the regulating member, and a second virtual plane passing through rotation centers of the developer holding body and transport member, and that interrupts movement of the developer pushed and moving in the radial direction of the transport blade.

7 Claims, 23 Drawing Sheets

DEVELOPING DEVICE, VISIBLE IMAGE FORMING DEVICE, AND IMAGE FORMING APPARATUS

CROSS-REFERENCE TO RELATED APPLICATIONS

This application is based on and claims priority under 35 USC 119 from Japanese Patent Application No. 2011-050780 filed Mar. 8, 2011.

BACKGROUND

The present invention relates to a developing device, a visible image forming device, and an image forming apparatus.

SUMMARY

According to an aspect of the invention, there is provided a developing device including a developer container that houses a developer; a developer holding body that is supported by the developer container and includes a magnet member including a plurality of magnetic poles on an outer peripheral surface of the magnet member, and a substantially cylindrical member that is provided outside the magnet member and rotates while holding the developer on an outer surface of the substantially cylindrical member, the developer being attracted by a magnetic force of the magnet member; a transport member that transports the developer while stirring the developer and includes a rotating shaft extending along the developer holding body, and a substantially spiral transport blade supported by the rotating shaft; a layer-thickness regulating member that faces the developer holding body and regulates a thickness of a layer of the developer held on the developer holding body; the magnet member including an attracting magnetic pole that causes the developer transported by the transport member to be attracted to the developer holding body; and an interrupting member that is arranged between the developer holding body and the transport member and interrupts movement of the developer, the interrupting member intersecting with a first virtual plane and a second virtual plane, the first virtual plane being adjacent to a rotation locus of an outer edge in a radial direction of the transport blade, the first virtual plane passing through a facing position at which the layer-thickness regulating member faces the developer holding body, the first virtual plane being adjacent to the rotation locus at a position at which a speed in a circumferential direction of the transport blade has a speed component in a direction toward the layer-thickness regulating member, the second virtual plane passing through a rotation center of the developer holding body and a rotation center of the transport member, the interrupting member interrupting the movement of the developer that is pushed in the radial direction of the transport blade when the developer is transported by the transport member and that moves toward the developer holding body.

BRIEF DESCRIPTION OF THE DRAWINGS

Exemplary embodiment(s) of the present invention will be described in detail based on the following figures, wherein.

DETAILED DESCRIPTION

Figure 1:
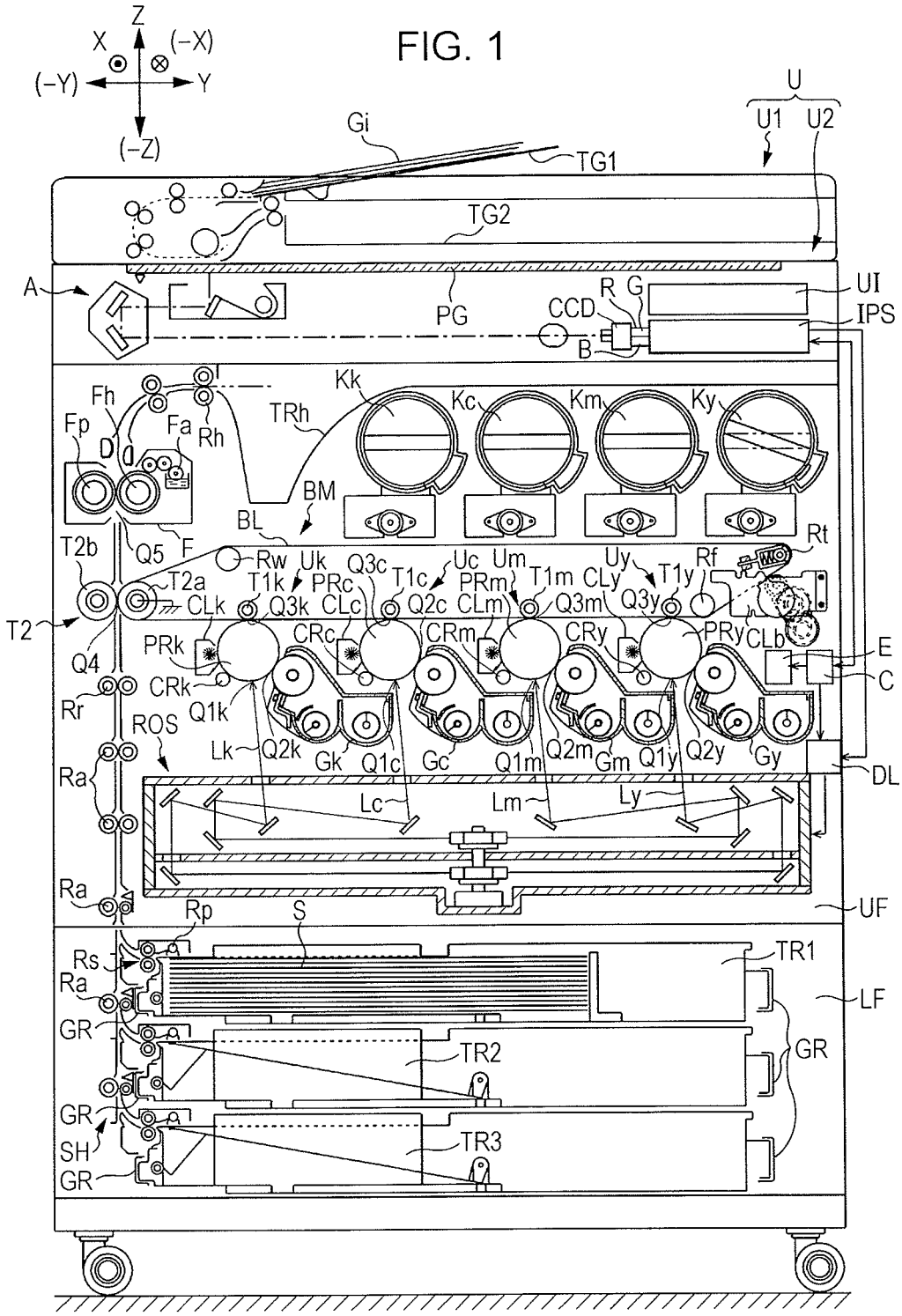
FIG. 1 is a front cross-sectional view of an image forming apparatus according to a first exemplary embodiment of the invention.

Specific examples of exemplary embodiments of the present invention (hereinafter, referred to as exemplary embodiments) will be described below with reference to the drawings. However, it is to be noted that the present invention is not limited to the exemplary embodiments.

For easier understanding of the following description, an X-axis direction represents a front-rear direction, a Y-axis direction represents a left-right direction, and a Z-axis direction represents an up-down direction. Directions indicated by arrows X, −X, Y, −Y, Z, and −Z respectively represent forward, rearward, rightward, leftward, upward, and downward, or a front side, a rear side, a right side, a left side, an upper side, and a lower side.

Also, a symbol in which a dot "•" is arranged in a circle "○" represents an arrow directed from the back side to the front side of a drawing sheet, and a symbol in which a cross "x" is arranged in a circle "○" represents an arrow directed from the front side to the back side of the drawing sheet.

In the following description with the drawings, illustration of parts other than parts required for easier understanding of the description is properly omitted.

First Exemplary Embodiment

FIG. 1 is a front cross-sectional view of an image forming apparatus according to a first exemplary embodiment of the invention.

Referring to FIG. 1, a copier U as an example of an image forming apparatus according to the first exemplary embodiment of the invention includes an automatic document transport device U1 and an image forming apparatus body U2 that supports the automatic document transport device U1 and has a transparent document table PG at an upper end thereof.

The automatic document transport device U1 includes a document feed portion TG1 on which plural documents Gi to be copied are stacked, and a document output portion TG2, to which the documents Gi transported from the document feed portion TG1 and passing through a copy position that is an example of a document reading position on the document table PG, are output.

The image forming apparatus body U2 includes an operation unit UI, an exposure optical system A, etc. A user uses the operation unit UI to input an operation command signal, such as copy start.

Reflection light from the document Gi transported on the document table PG in the automatic document transport device U2, or reflection light from a document manually placed on the document table PG passes through the exposure optical system A, and is converted into electric signals of red R, green G, and blue B by a solid-state imaging device CCD.

An image converter IPS converts the electric signals of RGB input from the solid-state image pickup device CCD into image information of black K, yellow Y, magenta M, and cyan C, and temporarily stores the image information. The image converter IPS outputs the image information to a latent-image forming device driving circuit DL at a predetermined timing as image information for forming a latent image.

If a document image is a single-color image or a monochromatic image, image information of only black is input to the latent-image forming device driving circuit DL.

The latent-image forming device driving circuit DL includes latent-image forming device driving circuits (not shown) for the respective colors Y, M, C, and K. The latent-image forming device driving circuits output latent-image forming device driving signals corresponding to input image information to latent-image write-light irradiating units (not shown) for the respective colors of a latent-image forming device R0S.

Figure 2:
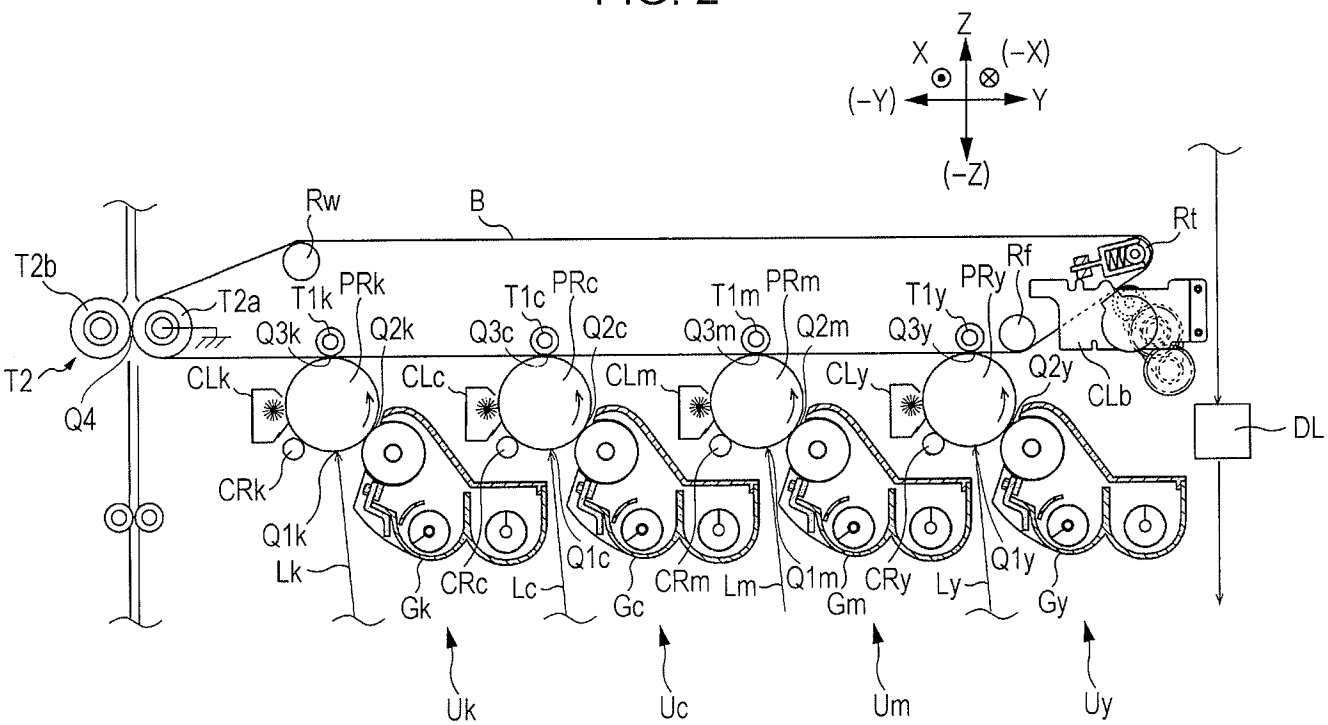
FIG. 2 is an enlarged view of a feature portion of the image forming apparatus according to the first exemplary embodiment of the invention.

FIG. 2 is an enlarged view of a feature portion of the image forming apparatus according to the first exemplary embodiment of the invention.

Visible-image forming devices Uy, Um, Uc, and Uk arranged above the latent-image forming apparatus R0S are devices that form toner images, each of which is an example of a visible image, of the respective colors including yellow Y, magenta M, cyan C, and black K.

Latent-image write-light irradiating units (not shown) of the latent-image forming apparatus R0S emit laser beams Ly, Lm, Lc, and Lk of Y, M, C, and K as examples of the latent-image write light. The laser beams Ly, Lm, Lc, and Lk are respectively incident on rotating image holding bodies PRy, PRm, PRc, and PRk.

The visible-image forming device Uy of Y includes the rotating image holding body PRy, a charging roller CRy, a developing device Gy, a first transfer roller T1*y*, and an image holding body cleaner CLy. Any of the visible-image forming devices Um, Uc, and Uk has a configuration similar to that of the visible-image forming device Uy of Y.

The image holding bodies PRy, PRm, PRc, and PRk are uniformly charged with electricity by charging rollers CRy, CRm, CRc, and CRk, each of which is an example of a charging unit, and then electrostatic latent images are formed on surfaces of the image holding bodies PRy, PRm, PRc, and PRk at image write positions Q1*y*, Q1*m*, Q1*c*, and Q1*k* with the laser beams Ly, Lm, Lc, and Lk. The electrostatic latent images on the surfaces of the image holding bodies PRy, PRm, PRc, and PRk are developed into toner images by the developing devices Gy, Gm, Gc, and Gk in developing regions Q2*y*, Q2*m*, Q2*c*, and Q2*k*.

The developed toner images are transported to first transfer regions Q3*y*, Q3*m*, Q3*c*, and Q3*k* that are brought into contact with an intermediate transfer belt BL as an example of an intermediate transfer body. In the first transfer regions Q3*y*, Q3*m*, Q3*c*, and Q3*k*, a first transfer voltage is applied at a predetermined timing from a power supply circuit E controlled by a controller C to first transfer rollers T1*y*, T1*m*, T1*c*, and T1*k*, each of which is an example of a first transfer device, arranged at the back surface of the intermediate transfer belt BL. The first transfer voltage has a polarity opposite to a charge polarity of the toner.

The toner images on the image holding bodies PRy to PRk are first-transferred on the intermediate transfer belt BL by the first transfer rollers T1*y*, T1*m*, T1*c*, and T1*k*. Image holding body cleaners CLy, CLm, CLc, and CLk, each of which is an example of an image holding body cleaner, clean the toners remaining on the surfaces of the image holding bodies PRy, PRm, PRc, and PRk after the first transfer.

A belt module BM as an example of an intermediate transfer device is arranged above the image holding bodies PRy to PRk. The belt module BM is vertically movable and is able to be pulled forward. The belt module BM includes the intermediate transfer belt BL, a tension roller Rt as an example of a tension apply member; a working roller Rw as an example of an anti-meander member; an idler roller Rf as an example of a driven member; a backup roller T2*a* as an example of a second transfer facing member which also serves as a driving roller as an example of a driving member; and the first transfer rollers T1*y*, T1*m*, T1*c*, and T1*k*. The tension roller Rt, the working roller Rw, and the idler roller Rf, and the backup roller T2*a* that also serves as the driving roller form a belt support roller Rt+Rw+Rf+T2*a* which is an example of an intermediate transfer body support member. The intermediate transfer belt BL is rotatably supported by the belt support roller Rt+Rw+Rf+T2*a*. A drive that rotates the backup roller T2*a* also serving as the driving roller, the belt support roller Rt+Rw+Rf+T2*a*, etc., form an intermediate transfer belt drive.

A second transfer roller T2*b* as an example of a second transfer member faces the front surface of the intermediate transfer belt BL at which the backup roller T2*a* is in contact with the intermediate transfer belt BL. The rollers T2*a* and T2*b* form a second transfer unit T2 according to the first exemplary embodiment. Also, a second transfer region Q4 is formed in a region where the second transfer roller T2*b* faces the intermediate transfer belt BL.

The toner images that are successively superposed on the intermediate transfer belt BL by the first transfer rollers T1*y*, T1*m*, T1*c*, and T1*k* at the first transfer regions Q3*y*, Q3*m*, Q3*c*, and Q3*k* are transported to the second transfer region Q4.

Three pairs of guide rails GR, each pair of which is an example of a pair of left and right guide portions, are provided below the latent-image forming device R0S. The guide rails GR support paper feed trays TR1 to TR3, each of which is an example of a medium feed portion. The paper feed trays TR1 to TR3 are able to be loaded and unloaded in the front-rear direction. The paper feed tray TR1 to TR3 house recording sheets S, each of which is an example of a medium. The recording sheets S are picked up by a pickup roller Rp as an example of a medium pickup member, and are separated one by one by a separator roller Rs as an example of a separator member. The recording sheet S separated by the separator roller Rs is transported by a sheet transport roller Ra as an example of a medium transport member, to a registration roller Rr as an example of a paper-feed-timing adjustment member. Plural sheet transport rollers Ra are provided along a transport path SH that is formed by a medium guide member, which is so-called sheet guide. The registration roller Rr is arranged upstream of the second transfer region Q4 in a sheet transport direction. The transport path SH, the sheet transport rollers Ra, the registration roller Rr, etc., form a sheet transport device SH+Ra+Rr.

The registration roller Rr transports the recording sheet S to the second transfer region Q4 in synchronization with a timing at which the toner images formed on the intermediate transfer belt BL are transported to the second transfer region Q4. When the recording sheet S passes through the second transfer region Q4, the backup roller T2*a* is grounded, and the electric circuit E controlled by the controller C applies a second transfer voltage to the second transfer roller T2*b* at a predetermined timing. The second transfer voltage has a polarity opposite to a charge polarity of the toner. At this time, the toner images on the intermediate transfer belt BL are transferred on the recording sheet S by the second transfer unit T2.

A belt cleaner CLb as an example of a cleaner for the intermediate transfer body, cleans the intermediate transfer belt BL after the second transfer.

The first transfer rollers T1*y* to T1*k*, the intermediate transfer belt BL, the second transfer unit T2, etc., form a transfer device T1*y* to T1*k*+T2+BL.

The recording sheet S with the toner image second-transferred thereon is transported to a fixing device F. The fixing device F includes a heat roller Fh as an example of a heat fixing member, and a pressure roller Fp as an example of a pressure fixing member. When the recording sheet S passes through a fixing region Q5, which is a pressure contact region of the heat roller Fh and the pressure roller Fp, the unfixed toner image on a surface of the recording sheet S is heated and fixed. An output roller Rh as an example of a medium output member outputs the recording sheet S with the toner image fixed thereto, to a paper output tray TRh as an example of a medium output portion.

At this time, a release-agent apply device Fa applies a release agent to a surface of the heat roller Fh so that the recording sheet S is easily released from the heat roller Fh.

Toner cartridges Ky, Km, Kc, and Kk, each of which is an example of a developer supply container, are arranged above the belt module BM. The toner cartridges Ky, Km, Kc, and Kk house developers of the respective colors Y, M, C, and K. The developers housed in the toner cartridges Ky, Km, Kc, and Kk are supplied to the developing devices Gy, Gm, Gc, and Gk through developer supply paths (not shown) in accordance with consumption of the developers by the developing devices Gy, Gm, Gc, and Gk.

Referring to FIG. 1, the image forming apparatus U includes an upper frame body UF and a lower frame body LF. The upper frame body UF supports the latent-image forming device R0S and members arranged above the latent-image forming device R0S, the members including the image holding bodies PRy, PRm, PRc, and PRk, the developing devices Gy, Gm, Gc, and Gk, the belt module BM, etc.

The lower frame body LF supports the guide rails GR that support the paper feed trays TR1 to TR3, paper feed members that feed paper from the trays TR1 to TR3, etc., the members including the pickup roller Rp, the separator roller Rs, and the sheet transport rollers Ra.

Description of Developing Devices Gy to Gk

Figure 3:
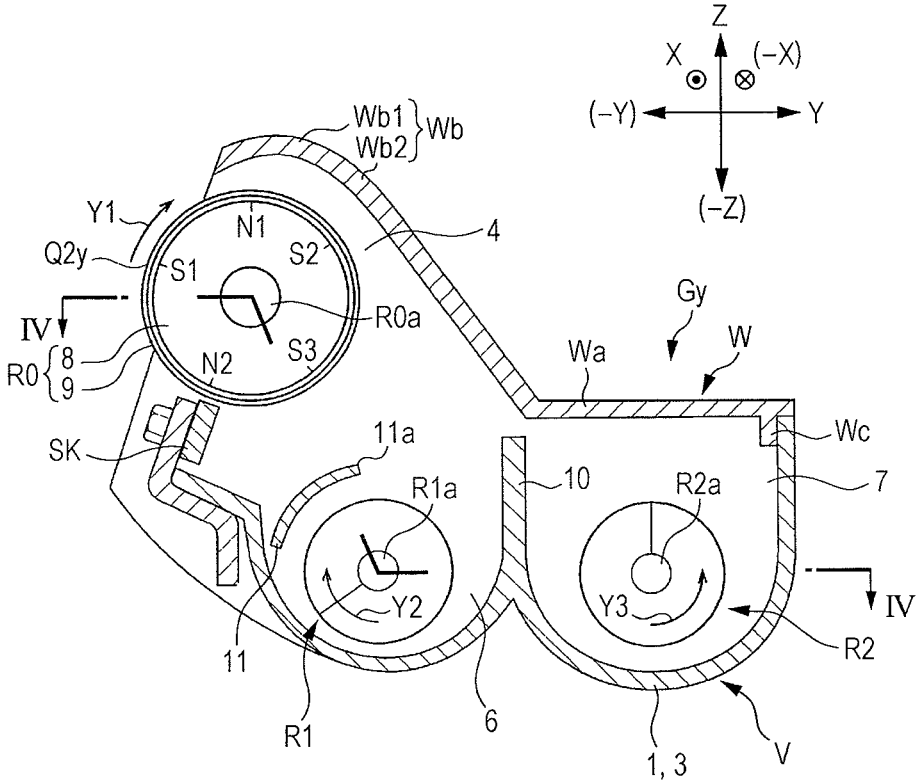
FIG. 3 is an explanatory view of a developing device according to the first exemplary embodiment of the invention.

FIG. 3 is an explanatory view of a developing device according to the first exemplary embodiment of the invention.

Figure 4:
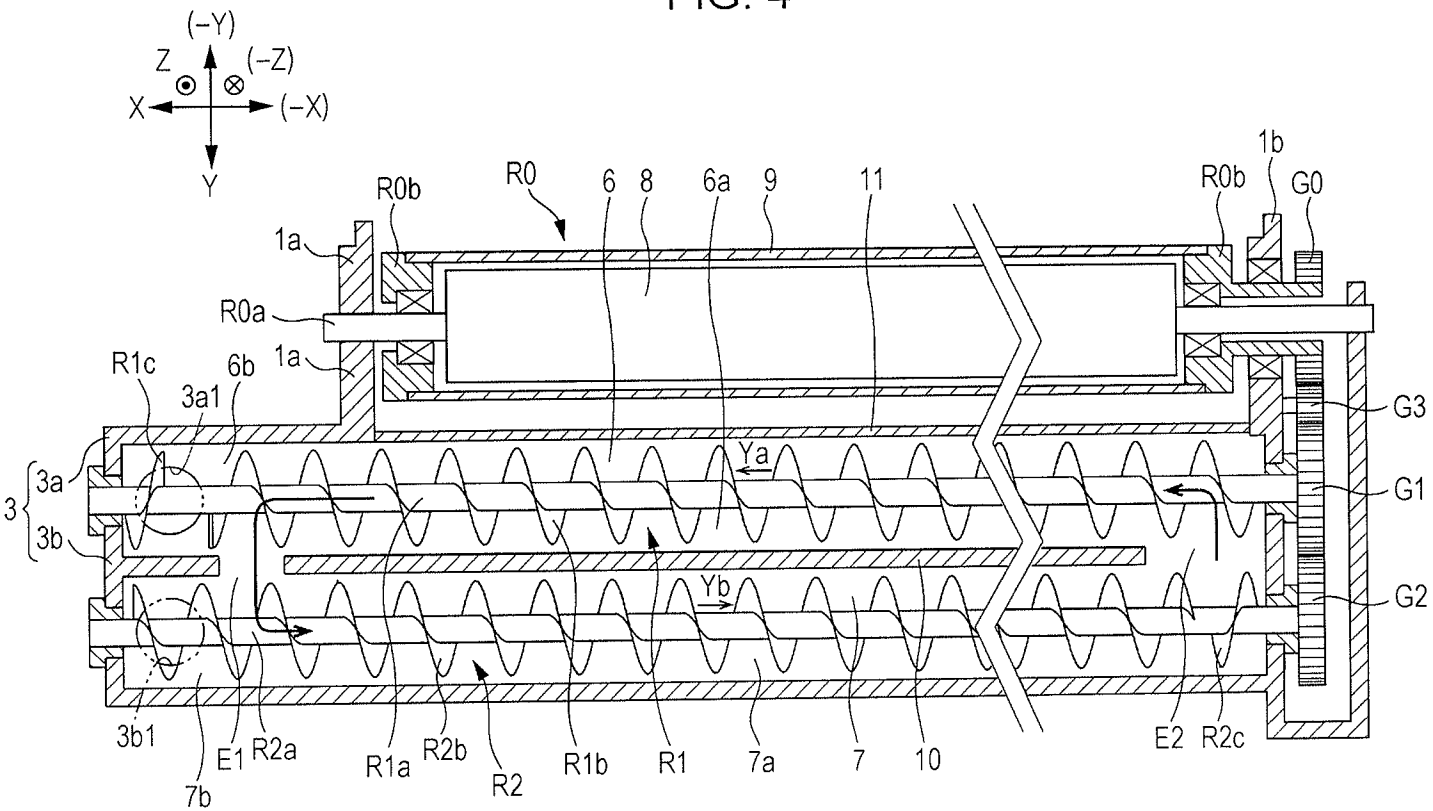
FIG. 4 is a cross-sectional view taken along line IV-IV in FIG. 3.

FIG. 4 is a cross-sectional view taken along line IV-IV in FIG. 3.

It is to be noted that, since the developing devices Gy, Gm, Gc, and Gk have similar configurations, in the following description, the developing device Gy for Y color is described, and the description of the other developing devices Gm, Gc, and Gk is omitted.

Referring to FIGS. 3 and 4, the developing device Gy facing the image holding body PRy in the developing region Q2*y* includes a developer container V that houses the developer. The developer container V houses a two-component developer including a toner electrically charged to have a negative polarity or −polarity, and a magnetic carrier electrically charged to have a positive polarity or +polarity. The developer container V includes a developer container body 1 and a developer container cover W as an example of a lid member that closes an upper end of the developer container body 1. As shown in FIG. 4, a forward protruding portion 3 that protrudes forward from the developer container body 1 is integrally formed with the developer container body 1 at the front side thereof. The developer container body 1 includes a front wall 1*a* and a rear wall 1*b*. Both ends of a layer-thickness regulating member SK that extends in a longitudinal direction of the developing device Gy are fixed to the front wall 1*a* and the rear wall 1*b*.

Referring to FIG. 3, the developer container body 1 includes a developing roller chamber 4, a first stirring chamber 6 adjacent to the developing roller chamber 4, and a second stirring chamber 7 adjacent to the first stirring chamber 6. The developing roller chamber 4 is an example of a holding body housing chamber and houses a developing roller R0 as an example of a developer holding body. The developer container cover W includes an upper wall Wa arranged above the second stirring chamber 7, a developer holding body housing wall Wb that extends from a left end portion of the upper wall Wa and forms the developing roller chamber 4, and a fitting portion We that extends downward from a right portion of the upper wall Wa and is fitted to an inner wall of the developer container body 1. The developer holding body housing wall Wb includes an arcuate top wall Wb1 and a flat plate-like inclined wall Wb2.

Referring to FIG. 4, the first stirring chamber 6 includes a first main stirring chamber 6*a* at the developer container body 1, and a discharge chamber 6*b* at a left portion 3*a* of the forward protruding portion 3. The second stirring chamber 7 includes a second main stirring chamber 7*a* at the developer container body 1, and a supply chamber 7*b* at a right portion 3*b* of the forward protruding portion 3. A partition wall 10 is arranged between the first stirring chamber 6 and the second stirring chamber 7 in the developer container body 1. The partition wall 10 partitions a portion into the first main stirring chamber 6*a* and the second main stirring chamber 7*a* except for both end portions thereof. That is, the first main stirring chamber 6*a* and the second main stirring chamber 7*a* are formed to allow the developer to flow into a front inflow portion E1 and a rear inflow portion E2 at both end portions in the front-rear direction.

The first stirring chamber 6 and the second stirring chamber 7 form a circulation stirring chamber 6+7 according to the first exemplary embodiment.

Referring to FIG. 4, a developer discharge port 3*a*1 is provided at a lower section of the left portion 3*a* of the forward protruding portion 3, and a supply port 3*b*1 is provided at an upper section of the right portion 3*b* of the forward protruding portion 3. The supply port 3*b*1 is arranged such that the developer that is newly supplied is not discharged immediately after the supply.

Referring to FIGS. 3 and 4, the developing roller R0 includes a magnet roller 8 that is an example of a magnet member and is fixed to and supported by the developer container V through a developer holding body shaft R0*a*; and a developing sleeve 9 that is an example of a cylindrical or substantially cylindrical member, is supported rotatably at an outer periphery of the magnet roller 8, and rotates in a Y1 direction which is an antigravity direction in the developing region Q2*y*.

The magnet roller 8 includes plural magnetic poles on an outer peripheral surface of the magnet roller 8. The magnet roller 8 according to the first exemplary embodiment includes a developing magnetic pole S1 facing the image holding body PRy, a layer-thickness regulating magnetic pole N2 that is arranged upstream of the developing magnetic pole S1 in a rotation direction of the developing sleeve 9 and faces the layer-thickness regulating member SK, a transport magnetic pole N1 that is arranged downstream of the developing magnetic pole S1 in the rotation direction of the developing sleeve 9, a pickoff magnetic pole S2 that is arranged downstream of the transport magnetic pole N1 in the rotation direction of the developing sleeve 9 and is an example of a release magnetic pole, and a pickup magnetic pole S3 that is arranged between the pickoff magnetic pole S2 and the layer-thickness regulating magnetic pole N2 and is an example of an attracting magnetic pole.

If the developer in the first main stirring chamber 6*a* is attracted to the surface of the developing sleeve 9 by the pickup magnetic pole S3, the developer is held on the developing sleeve 9 and rotated in the Y1 direction. The thickness of a layer of the developer held on the developing sleeve 9 is regulated by the layer-thickness regulating magnetic pole N2 and the layer-thickness regulating member SK, and the developer is transported to the developing region Q2*y*.

Referring to FIG. 4, an outer peripheral shaft R0*b* that supports the developing sleeve 9 is rotatably supported at the outer periphery side of the developer holding body shaft R0*a*. The outer peripheral shaft R0*b* is located at each of the front and rear sides of the developing sleeve 9. As shown in FIG. 4, a gear G0 as an example of a drive transmitting member is fixed to and supported by at the outer peripheral shaft R0*b* at the rear side. When the gear G0 is rotated, the outer peripheral shaft R0*b* is rotated around the developer holding body shaft R0*a* and hence the developing sleeve 9 is rotated around the outer periphery of the magnet roller 8.

Referring to FIGS. 3 and 4, a first auger R1 is arranged in the first stirring chamber 6. The first auger R1 is an example of a first transport member and transports the developer while stirring the developer.

Referring to FIG. 4, the first auger R1 includes a rotating shaft R1*a* extending in an axial direction of the developing roller R0, and a forward transport blade R1*b* and a backward transport blade R1*c* that are supported around the outer periphery of the rotating shaft R1*a*. Each of the forward transport blade R1*b* and the backward transport blade R1*c* is an example of a spiral or substantially spiral transport blade. The forward transport blade R1*b* is provided from the rear inflow portion E2 to the front inflow portion E1 in order to transport the developer from the rear side to the front side in a first transport direction Ya. The backward transport blade R1*c* is provided near the developer discharge port 3*a*1. The backward transport blade R1*c* transports the developer in a direction opposite to the transport direction by the forward transport blade R1*b*, so that the developer flows to the second stirring chamber 7 from the first stirring chamber 6. The rotating shaft R1*a* is rotatably supported by a front wall of the left portion 3*a* of the forward protruding portion 3 and a rear wall of the developer container body 1. A gear G1 is supported at a rear end portion of the rotating shaft R1*a*, i.e., at an end portion at the −X side in FIG. 4.

Referring to FIGS. 3 and 4, a second auger R2 is arranged in the second stirring chamber 7. The second auger R2 is an example of a second transport member and transports the developer while stirring the developer. The second auger R2 includes a rotating shaft R2*a* for the second auger R2, and a forward transport blade R2*b* and a backward transport blade R2*c*.

Referring to FIG. 4, the forward transport blade R2*b* of the second auger R2 is provided from the supply port 3*b*1 to the rear inflow portion E2 in order to transport the developer from the front side to the rear side in a second transport direction Yb. The backward transport blade R2*c* is provided near a rear end of the rear inflow portion E2. The backward transport blade R2*c* transports the developer in a direction opposite to the transport direction by the forward transport blade R2*b*, so that the developer flows to the first stirring chamber 6 from the second stirring chamber 7. The rotating shaft R2*a* of the second auger R2 is rotatably supported by a front wall of the right portion 3*b* of the forward protruding portion 3 and the rear wall of the developer container body 1. A gear G2 is supported at a rear end portion of the rotating shaft R2*a*.

Referring to FIGS. 3 and 4, the gear G0 of the developing roller R0 meshes with the gear G1 of the first auger R1 through an intermediate gear G3, and the gear G1 meshes with the gear G2 of the second auger R2. A rotating force of a developing device motor as an example of a developing device drive source (not shown) is transmitted to the gear G0. When the gear G0 is rotated by the developing device motor, the gear G1 is rotated in a Y2 direction that is the same as the direction of the gear G0. The gear G1 and the gear G2 are rotated in mutually opposite directions. In particular, the gear G2 is rotated in a Y3 direction. That is, the first auger R1 that is rotated with the gear G1 and the second auger R2 that is rotated with the gear G2 are rotated in mutually opposite directions. When the first auger R1 and the second auger R2 are rotated, the developer in the first stirring chamber 6 and the developer in the second stirring chamber 7 are transported and circulate in mutually opposite directions. At this time, the developer transported by the first auger R1 is supplied to the developing roller R0.

Description of Curved Block 11

Figure 5A:
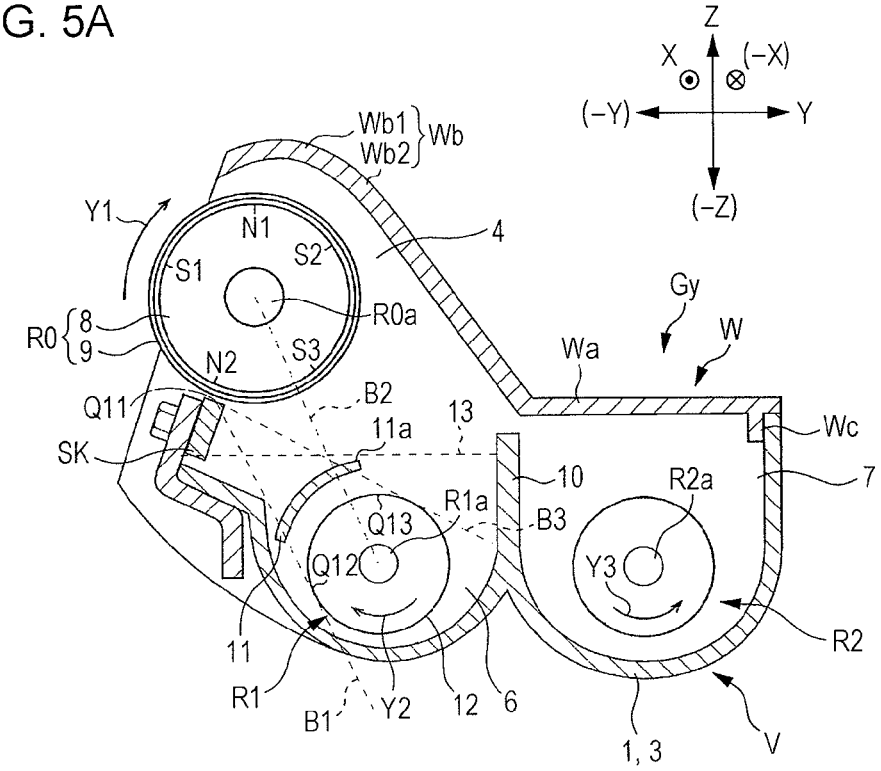
FIGS. 5A and 5B are explanatory views of an arrangement position of an interrupting member according to the first exemplary embodiment of the invention, FIG. 5A being an illustration corresponding to FIG. 3, FIG. 5B being an enlarged view of an area near a layer-thickness regulating member.
Figure 5B:
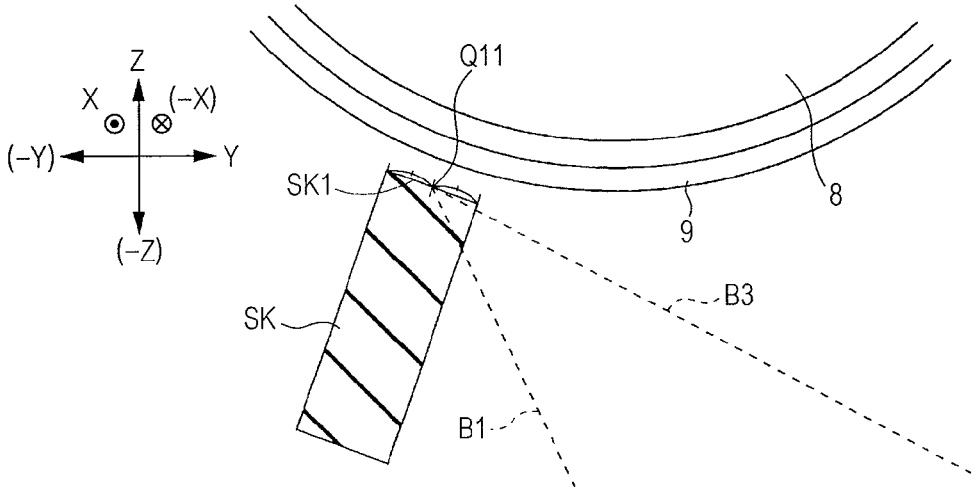

FIGS. 5A and 5B are explanatory views of an arrangement position of an interrupting member according to the first exemplary embodiment of the invention, FIG. 5A being an illustration corresponding to FIG. 3, FIG. 5B being an enlarged view of an area near a layer-thickness regulating member.

Referring to FIGS. 3 to 5B, a curved block 11 is arranged between the developing roller R0 and the first auger R1. The curved block 11 is an example of an interrupting member, and interrupts movement of the developer that moves toward the developing roller R0. The curved block 11 is supported by front and rear wall surfaces of the developer container V. The curved block 11 has a partial cylinder that is curved along a locus, which is plotted by the transport blades R1*b* and R1*c* when the first auger R1 is rotated. That is, the partial cylinder is curved along a rotation locus 12 of an outer edge in a radial direction of the transport blade R1*b*.

Referring to FIG. 5A, the curved block 11 according to the first exemplary embodiment has an upper end 11*a*. The upper end 11*a* is arranged below a predetermined lower-limit level 13 of the developer in a gravity direction, the developer which is transported to the first auger R1. In the first exemplary embodiment, the lower-limit level 13 of the developer is a level of the developer when the toner in the developer is consumed and only the carrier remains. The level 13 of the developer is not limited thereto. A desirable level may be determined depending on a configuration of a developing device. For example, a level of a developer when an image with a maximum printable toner consumption is printed, or a level that is obtained by adding or subtracting an allowance value or so-called margin to or from the lower-limit level 13, may be determined.

Referring to FIG. 5A, the curved block 11 intersects with a first virtual plane B1, a second virtual plane B2, and a third virtual plane B3.

The second virtual plane B2 passes through a rotation center of the developing roller R0 and a rotation center of the first auger R1.

The first virtual plane B1 and the third virtual plane B3 are adjacent to the rotation locus 12. The first virtual plane B1 and the third virtual plane B3 pass through a facing position Q11 at which the layer-thickness regulating member SK faces the developing roller R0. The first virtual plane B1 is adjacent to the rotation lotus 12 at a position Q12 at which a speed in a circumferential direction of the transport blade R1*b* has a speed component in a direction toward the layer-thickness regulating member SK. The third virtual plane B3 is adjacent to the rotation lotus 12 at a position Q13 at which the speed in the circumferential direction of the transport blade R1*b* has a speed component in a direction away from the layer-thickness regulating member SK.

In the first exemplary embodiment, as shown in FIG. 5B, the facing position Q11 is on an end portion SK1 of the layer-thickness regulating member SK facing the developing roller R0, and in particular, the facing position Q11 is at a center position in the rotation direction of the developing sleeve 9. However, the position of the facing position Q11 is not limited to the configuration according to the first exemplary embodiment. That is, the first virtual plane B1 and the third virtual plane B3 may be determined such that a desirable position in a space in which the layer-thickness regulating member SK faces the developing roller R0 is the facing position Q11. For example, a first virtual plane and a third virtual plane may be determined on the basis of that an upstream end of the end portion SK1 of the layer-thickness regulating member SK in the rotation direction of the developing sleeve 9 is a facing position.

The developer container V, the developing roller R0, the curved block 11, the first auger R1, the second auger R2, etc., form the developing device Gy.

Operation of First Exemplary Embodiment

In the copier U according to the first exemplary embodiment including the above-described configuration, electrostatic latent images are formed on surfaces of the image holding bodies PRy to PRk, and the developing devices Gy to Gk develop the latent images on the image holding bodies PRy to PRk into toner images with the developers held on the developing rollers R0.

At this time, in the developing devices Gy to Gk according to the first exemplary embodiment, the augers R1 and R2 having the spiral or substantially spiral transport blades R1*b*, R1*c*, R2*b*, and R2*c* are rotated, and hence the developers housed in the circulation stirring chambers 6+7 are transported while being stirred. The developer transported to each first stirring chamber 6 at the developing roller R0 is supplied to the developing roller R0, and the developer is attracted to and held by the developing roller R0.

Figure 6:
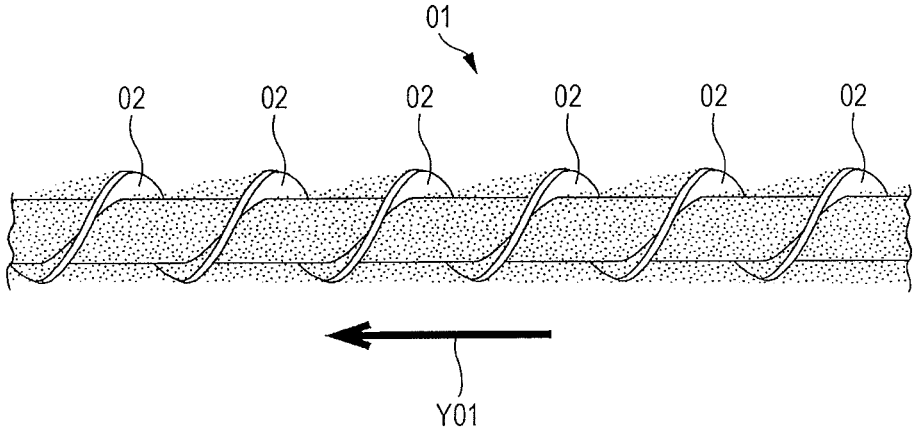
FIG. 6 is an explanatory view of an auger and an amount of a developer.

FIG. 6 is an explanatory view of an auger and an amount of a developer.

Referring to FIG. 6, when a transport member having a spiral or substantially spiral stirring blade, i.e., an auger 01 transports a developer in a direction indicated by arrow Y01, the amount of the developer is decreased at an upstream side of each portion of a spiral or substantially spiral transport blade 02, and the amount of the developer is increased at a downstream side. The amount of the developer is increased and decreased every pitch of the transport blade 02. The level of the developer may form wave-like bumps along an axial direction of the auger 01. In particular, for example, if the developer is consumed as the result of printing an image with a high density and the total amount of the developer becomes small, the level of the developer may likely form bumps.

Hence, when a developing roller attracts the developer stirred and transported by the auger 01, the amount of the developer attracted to the developing roller may likely vary depending on the position along the axial position of the auger 01. The amount of the developer held by the developing roller is increased and decreased in the axial direction and hence becomes uneven. As the result, a periodic oblique pattern corresponding to the portion of the stirring blade 02 may be formed.

Figure 7A:
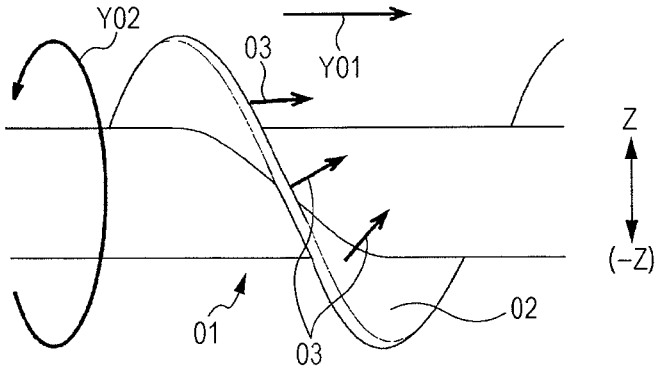
FIGS. 7A to 7D are illustrations explaining directions of forces applied by a transport blade of the auger to the developer, FIG. 7A being an explanatory view when the auger is viewed in a horizontal direction, FIG. 7B being an explanatory view when the auger is viewed from an obliquely upper side, FIG. 7C being an explanatory view when the auger is viewed from the upper side in the gravity direction, FIG. 7D being an explanatory view when the auger is viewed in an axial direction.
Figure 7B:
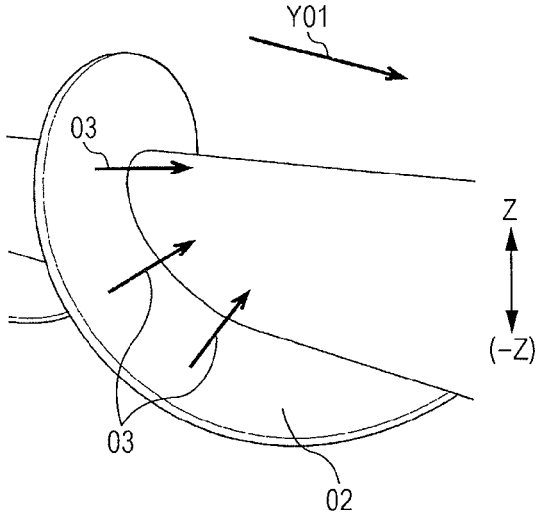
Figure 7C:
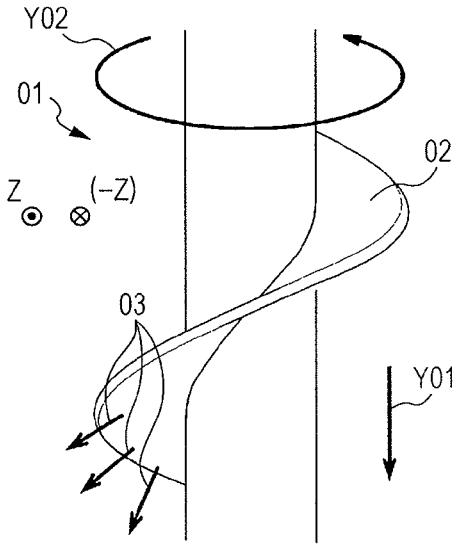
Figure 7D:
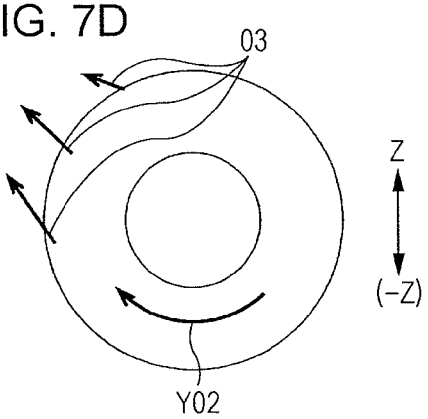

FIGS. 7A to 7D are illustrations explaining directions of forces applied by the transport blade of the auger to the developer, FIG. 7A being an explanatory view when the auger is viewed in a horizontal direction, FIG. 7B being an explanatory view when the auger is viewed from an obliquely upper side, FIG. 7C being an explanatory view when the auger is viewed from the upper side in the gravity direction, FIG. 7D being an explanatory view when the auger is viewed in the axial direction.

Also, as shown in FIGS. 7A to 7D, when the auger 01 transports the developer, if the auger 01 is rotated in a direction indicated by arrow Y02, the developer receives a force 03 from the rotating spiral or substantially spiral transport blade 02. That is, the rotating spiral or substantially spiral transport blade 02 applies a force to the developer to move in the transport direction Y01, and also applies a force to the developer to move in a circumferential direction and a radial direction away from the shaft. The developer between the developing roller and the auger 01 receives the force from the transport blade 02 in the direction toward the developing roller because of the force in the circumferential direction and the force in the radial direction, and may be attracted to and held by the developing roller not only by a magnetic force of the developing roller but also by the force received from the transport blade 02. A portion of the developer held by the developing roller and receiving the force from the transport blade 02 is held simply by a larger amount of the developer or with a higher density of the developer. The developer may be increased and decreased in the axial direction depending on the transport blade 02, and hence the developer may be uneven. In this case, an oblique pattern corresponding to the transport blade 02 of the auger 01 may be formed at the developing roller.

If a latent image on the image holding body is developed while a periodic oblique pattern is formed on the developing roller, a developed image is affected by the periodic oblique pattern, and a periodic oblique light and dark pattern depending on the transport blade 02, i.e., an auger mark may appear in an image on a recording sheet S. Consequently, image quality may be degraded. In particular, the auger mark may likely become noticeable if an image with a low density, or so-called half-tone image is printed.

With a configuration of related art, a magnetic force of a layer-thickness regulating magnetic pole is sufficiently increased, so that the thickness of a layer of a developer is regulated while the developer regulated by the layer-thickness regulating member is held by a constant amount at the upstream side of the layer-thickness regulating member. Even if the developing roller has a portion with a small amount of the developer and hence the amount of the developer is uneven, the level of the developer may be likely equalized, and likelihood of appearance of the auger mark is reduced.

However, in this case, the developer is continuously transported to the developer at the upstream side of the layer-thickness regulating member from the further upstream side. The developer may be compressed and may receive a load, and the developer may be deteriorated.

If the magnetic force of the layer-thickness regulating magnetic pole is decreased to decrease the load to the developer, the developer regulated by the layer-thickness regulating member is hardly held by the developing roller arranged upstream of the layer-thickness regulating member. The unevenness of the amount of the developer on the developing roller, the unevenness which is reduced by the held and accumulated developer, becomes hardly reduced. Also, if the holding amount of the developer on the developing roller arranged upstream of the layer-thickness regulating member is decreased, the developer receiving the force from the auger 01 likely directly moves to the upstream side of the layer-thickness regulating member. The developer on the developing roller receives a pressure from the developer moving from the auger 01 and hence density unevenness may appear. Consequently, the developer may be unevenly distributed on the developing roller.

With a configuration of related art, the unevenness of the amount of the developer on the developing roller is reduced, for example, by heightening a pseudo level or an actual level of a developer or by providing a second layer-thickness regulating member. However, with such a configuration, when the developer is attracted to the developing roller or when the thickness of the layer of the developer on the developing roller is regulated, a force of a transport blade may act on the developer, and density may be likely uneven between a portion with the force acting thereon and a portion without the force. The unevenness of the amount of the developer may not be eliminated from the developing roller.

In particular, if the level of the developer is heightened as compared with the entire auger to reduce an auger mark, part of the developing roller may be likely dipped into the developer. If the developer is pushed by the transport blade in the radial direction, a force depending on the transport blade is likely transmitted to the developing roller through the developer, and the developer on the developing roller may be concentrated. Hence, with the configuration that reduces the auger mark by heightening the level of the developer as compared with the entire auger, development is performed while the developer is concentrated. A part of an image corresponding to a portion of the developing roller with the concentrated developer may be printed with a high density.

Figure 8A:
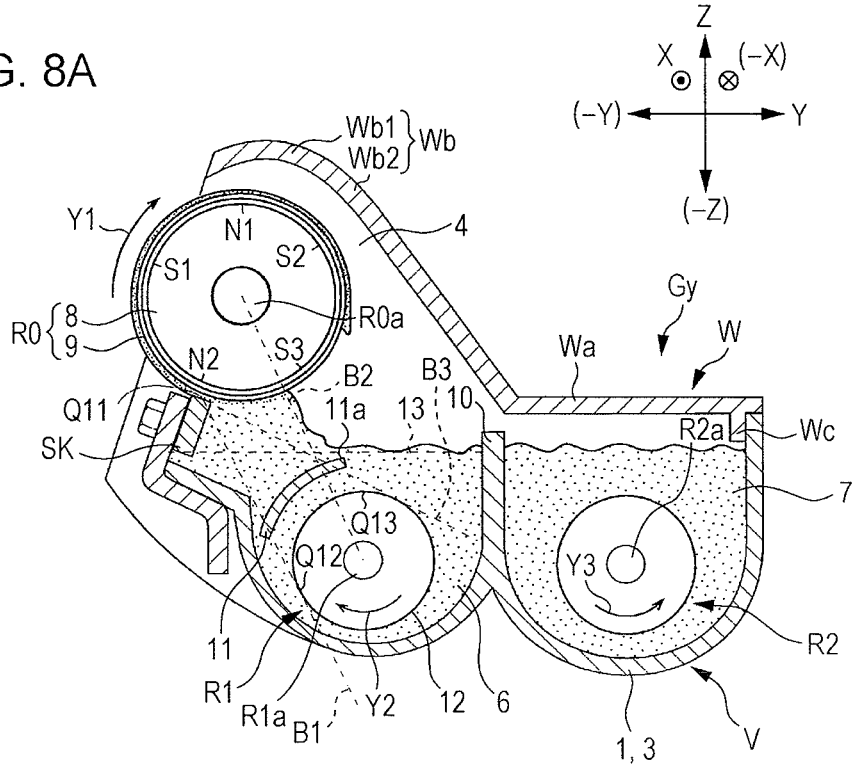
FIGS. 8A to 8C are operation explanatory views according to the first exemplary embodiment of the invention, FIG. 8A being an illustration corresponding to FIG. 5A, FIG. 8B being an enlarged view of FIG. 8A, FIG. 8C being an explanatory view when a case, in which the interrupting member is not provided, is compared with the first exemplary embodiment.
Figure 8B:
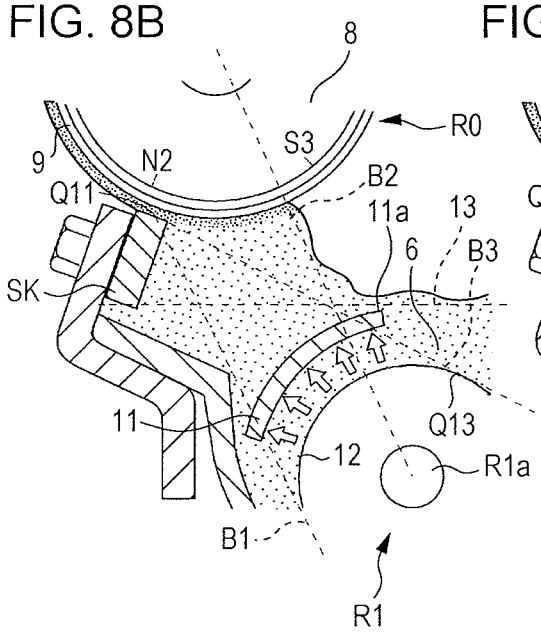
Figure 8C:
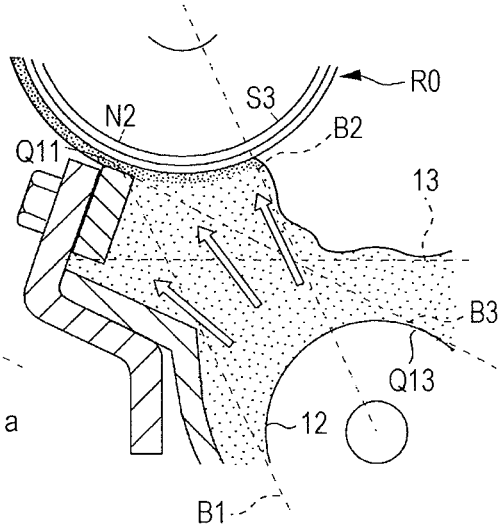

FIGS. 8A to 8C are operation explanatory views according to the first exemplary embodiment of the invention, FIG. 8A being an illustration corresponding to FIG. 5A, FIG. 8B being an enlarged view of FIG. 8A, FIG. 8C being an explanatory view when a case, in which the interrupting member is not provided, is compared with the first exemplary embodiment.

In contrast, in any of the developing devices Gy to Gk according to the first exemplary embodiment, the curved block 11 is arranged between the developing roller R0 and the first auger R1. As shown in FIGS. 8A and 8B, even if the developer transported by the first auger R1 is pushed in the radial direction from the transport blade R1*b* and intends to move toward the developing roller R0, the developer is interrupted by the curved block 11. In particular, a force acting in a direction from the first auger R1 to the development roller R0 is interrupted by the curved block 11. The developer near the developing roller R0 hardly directly receives the force in the direction from the first auger R1 to the developing roller R0. Accordingly, with any of the developing devices Gy to Gk according to the first exemplary embodiment, the developer is likely attracted to the developing roller R0 only by the magnetic force of the magnet roller 8. Likelihood of occurrence of the phenomenon in which the force from the first auger R1 is applied to the developer and hence the developer is excessively held on the developing roller R0 and the phenomenon in which the density of the developer is partially increased may be reduced. That is, with any of the developing devices Gy to Gk according to the first exemplary embodiment, as compared with the configuration of related art, the unevenness of the developer on the developing roller R0 is likely reduced.

In particular, in the first exemplary embodiment, the curved block 11 is curved along the rotation locus 12 of the first auger R1. When the developer is interrupted by the curved block 11, the developer is likely transported in the rotation direction Y2 of the first auger R1 along the curved block 11. If a portion of an interrupting member near the first auger R1 is not curved along the rotation locus 12, the force from the first auger R1 in the circumferential direction may hardly act on the developer between the interrupting member and the first auger R1, and the developer may stay in a space between the interrupting member and the first auger R1. The developer may continuously receive the force in the direction from the first auger R1 to the developing roller R0, and hence the developer may be deteriorated. In contrast, in the first exemplary embodiment, the curved block 11 is curved along the rotation locus 12. The developer between the curved block 11 and the first auger R1 receives the force from the first auger R1 in the circumferential direction and hence the developer easily moves. The developer passes through the area between the interrupting member and the first auger R1 in a short time and thus the developer is hardly deteriorated.

Also, the curved block 11 according to the first exemplary embodiment intersects with the first virtual plane B1 that connects the facing position Q11 and the contact position Q12. Accordingly, when the first auger R1 is rotated in the Y2 direction, even if the developer receives a force from the transport blade R1*b* passing through the position Q12 and intends to move toward the facing position Q11, the developer is likely interrupted by the curved block 11. In other words, the force from the first auger R1 hardly acts on the developer that is regulated by the layer-thickness regulating member SK, held by the regulating magnetic pole N2, and located at the upstream side of the facing position Q11. Likelihood of occurrence of the concentration of the developer depending on the transport blade R1*b* and likelihood of occurrence of the deterioration in the developer because the developer receives the force are reduced.

Further, the curved block 11 according to the first exemplary embodiment is the partial cylinder and intersects with the second virtual plane B2 in addition to the first virtual plane B1. Accordingly, the developer receiving the force from the first auger R1 hardly directly reaches a portion of the developing roller R0 extending from a position at which the developer is attracted to a position at which the thickness of the layer of the developer is regulated, i.e., a portion of the developing roller R0 holding the developer to be transported to the corresponding one of the developing regions Q2*y* to Q2*k*. Thus, in the first exemplary embodiment, the unevenness of the developer on the developing roller R0, such as density unevenness and amount unevenness, is more likely reduced as compared with a case in which the curved block 11 does not intersect with the first virtual plane B1 or the second virtual plane B2.

In the first exemplary embodiment, the curved block 11 also intersects with the third virtual plane B3 in addition to the first virtual plane B1. Accordingly, the direction from the first auger R1 to the facing position Q11 is interrupted. That is, in the first exemplary embodiment, even if the developer receives the force from the first auger R1 and intends to linearly move to the facing position Q11, the developer is completely interrupted.

Also, in the first exemplary embodiment, the upper end 11*a* of the curved block 11 is arranged below the predetermined lower-limit level 13 of the developer. The level of the developer is determined so as to be above the curved block 11 even if the developer is consumed. In the first exemplary embodiment, the curved block 11 is arranged between the developing roller R0 at the upper side and the first auger R1 at the lower side. Hence, if the upper end 11*a* of the curved block 11 is arranged above the lower-limit level 13 of the developer, the developer transported by the first auger R1 is interrupted by the curved block 11, and hardly moves to the developing roller R0 over the curved block 11. The developer may not be supplied to the developing roller R0. In contrast, in the first exemplary embodiment, the level of the developer is determined so as to be above the curved block 11 even if the developer is consumed. The developer moves in an area above the curved block 11 and is likely supplied to the developing roller R0 as compared with a case in which the upper end 11*a* of the curved block 11 is arranged above the lower-limit level 13.

Further, in the first exemplary embodiment, the lower-limit level 13 of the developer is above the first auger R1. Here, if the lower-limit level 13 of the developer is below the first auger R1 and an upper portion of the first auger R1 is exposed from the level of the developer, the developer hardly moves in the transport direction over the transport blades R1*b* and R1*c*. As shown in FIG. 6, the amount of the developer may be increased and decreased every pitch of the transport blade. In contrast, in the first exemplary embodiment, the level of the developer is located above the transport blades R1*b* and R1*c*. The level of the developer moves over the transport blades R1*b* and R1*c* and the developer is likely equalized. That is, according to the first exemplary embodiment, as compared with the configuration in which the upper portion of the auger is exposed to the upper side from the level of the developer, the level of the developer hardly forms wave-like bumps. The developer is likely attracted to the developing roller R0 while the level is equalized. Accordingly, in the first exemplary embodiment, as compared with the case in which the lower-limit level 13 of the developer is below the upper portion of the first auger R1, the unevenness of the developer on the developing roller R0 is likely reduced, and likelihood of formation of an oblique pattern depending on the transport blades R1*b* and R1*c*, such as an auger mark, is reduced.

EXAMPLES

Next, experiments to ensure functions of the copier U according to the first exemplary embodiment are performed.

Example 1

In Example 1, a copier DCC3300 manufactured by Fuji Xerox Co., Ltd. is modified and the configuration according to the first exemplary embodiment is applied. An image is printed, and an effect applied to a recorded image by the interrupting member is measured. In Example 1, an entirely solid image is continuously printed on 20 recording sheets. From among the 20 printed recording sheets, images in which oblique patterns depending on transport blades, such as auger marks, most noticeably appear are evaluated, and the effect by the interrupting member is measured. In Example 1, the measurement is performed as follows. If it is determined that the oblique pattern depending on the transport blade such as an auger mark does not appear, an evaluation value 1 is assigned. If it is determined that the pattern appears but is at an allowable level, an evaluation value 2 is assigned. If the pattern is slightly noticeable, an evaluation value 3 is assigned. If the pattern is noticeable, an evaluation value 4 is assigned. If the pattern is markedly noticeable, an evaluation value 5 is assigned.

Example 2

Figure 9:
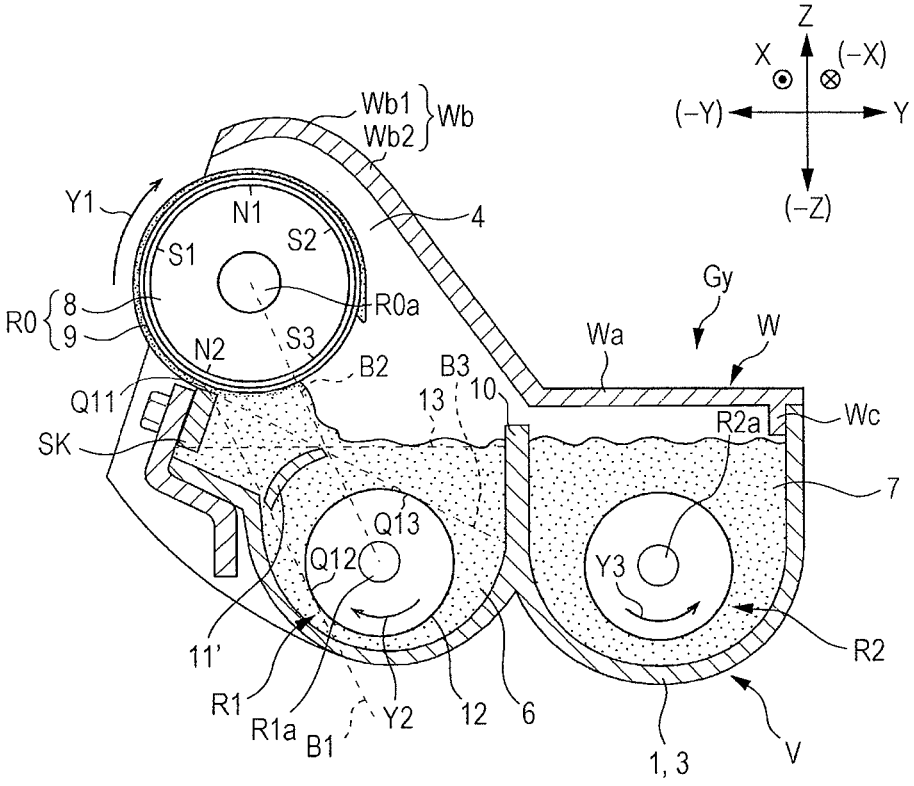
FIG. 9 is an explanatory view of Example 2.

FIG. 9 is an explanatory view of Example 2.

Referring to FIG. 9, in Example 2, developing devices Gy to Gk, each of which includes a curved block 11' as an example of an interrupting member instead of the curved block 11 according to the first exemplary embodiment, are used. The curved block 11' according to Example 2 is similar to the curved block 11 according to the first exemplary embodiment except that the curved block 11' is arranged so as not to intersect with the second virtual plane B2 and has a smaller cross-sectional area in an axial direction.

In Example 2, measurement is performed in a manner similar to Example 1 except that the developing devices Gy to Gk according to Example 2 are used.

Comparative Example 1

Figure 10:
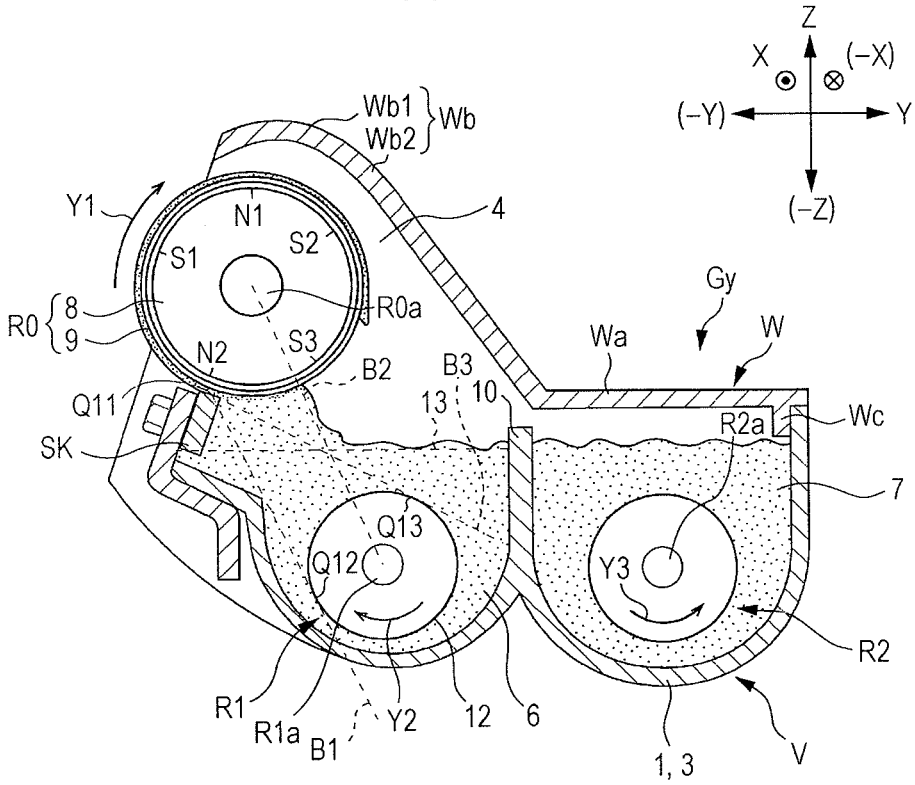
FIG. 10 is an explanatory view of Comparative Example 1.

FIG. 10 is an explanatory view of Comparative Example 1.

Referring to FIG. 10, in Comparative Example 1, developing devices Gy to Gk of related art, each of which does not have an interrupting member such as the curved block 11, are used. In Comparative Example 1, measurement is performed in a manner similar to Example 1 except that the developing devices Gy to Gk of related art are used.

Results of Examples

Figure 11:
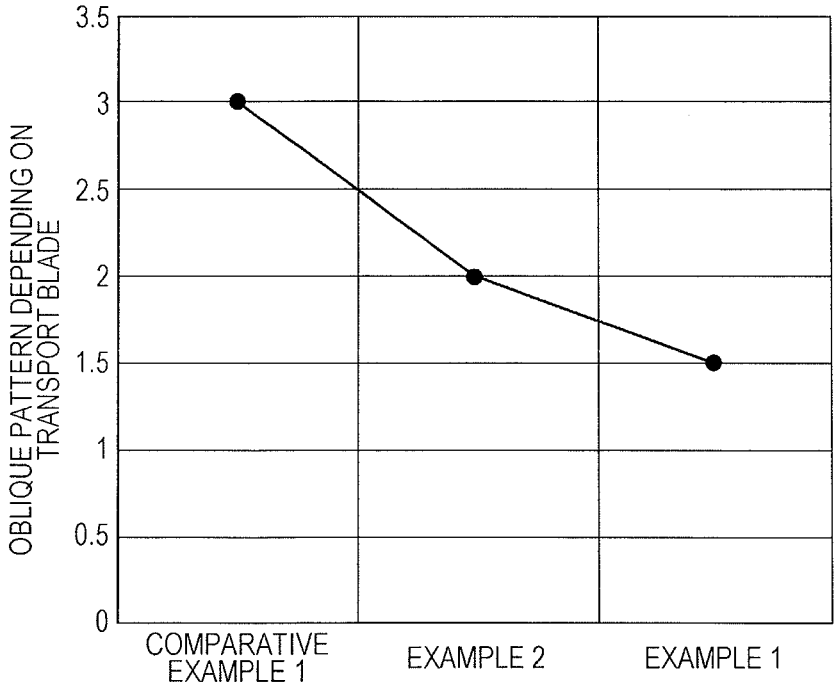
FIG. 11 is an explanatory view of experimental results of examples.

FIG. 11 is an explanatory view of experimental results of examples.

Referring to FIG. 11, an evaluation value 1.5 is obtained in Example 1. An evaluation value 2 is obtained in Example 2. In contrast, an evaluation value 3 is obtained in Comparative Example 1. Accordingly, with the configuration provided with the interrupting member, it is ensured that the likelihood of appearance of the oblique pattern depending on the transport blade, such as an auger mark, is reduced. That is, it is determined that the interrupting member affects the unevenness of the developer on the developing roller. Also, as compared with the configuration according to Example 2, the configuration according to Example 1 has a higher effect of reducing the unevenness of the developer on the developing roller.

Second Exemplary Embodiment

Description of Developing Device

Figure 12:
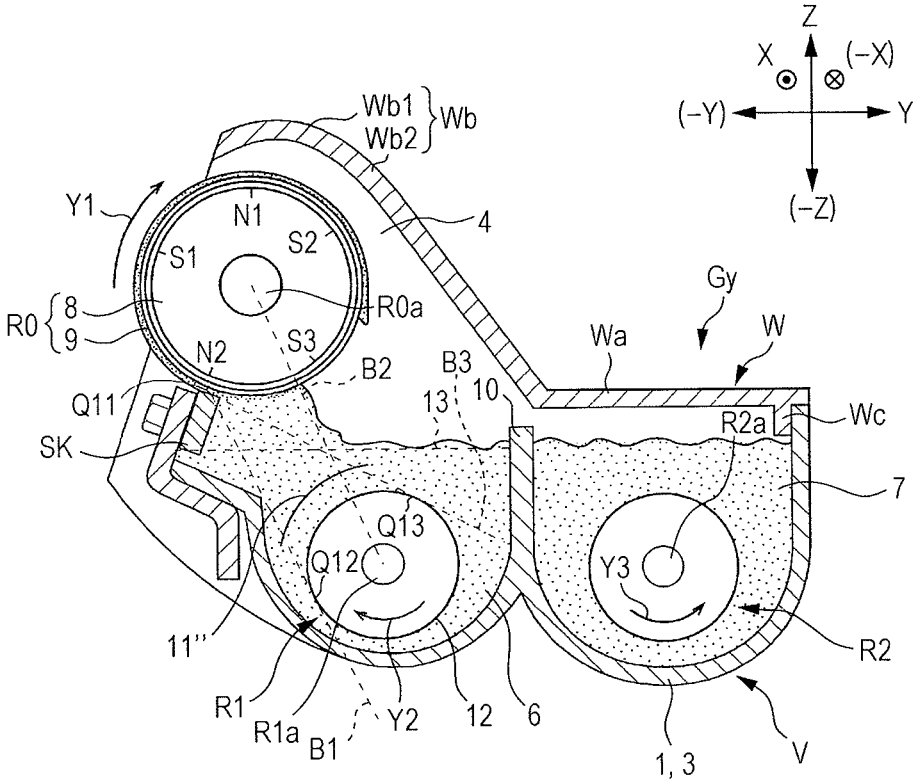
FIG. 12 is an explanatory view of a developing device according to a second exemplary embodiment of the invention, FIG. 12 being an explanatory view corresponding to FIG. 8A according to the first exemplary embodiment.

FIG. 12 is an explanatory view of a developing device according to a second exemplary embodiment of the invention, FIG. 12 being an explanatory view corresponding to FIG. 8A according to the first exemplary embodiment.

Referring to FIG. 12, developing devices Gy to Gk according to the second exemplary embodiment includes an interrupting film 11" as an example of an interrupting member, instead of the curved block 11 according to the first exemplary embodiment. The interrupting film 11" according to the second exemplary embodiment has a shape of a partial cylinder like the curved block 11 according to the first exemplary embodiment. The interrupting film 11" is supported by the front and rear wall surfaces of the developer container V, intersects with the virtual planes B1 to B3, and is arranged below the lower-limit level 13 of the developer.

Operation of Second Exemplary Embodiment

In each of the developing devices Gy to Gk according to the second exemplary embodiment with the above-described configuration, even if the developer receives the force from the first auger R1 and intends to move to the developing roller R0, the developer is interrupted by the interrupting film 11" arranged between the first auger R1 and the developing roller R0. Accordingly, even with the second exemplary embodiment, the unevenness of the developer on the developing roller R0 is reduced like the first exemplary embodiment.

Third Exemplary Embodiment

Figure 13:
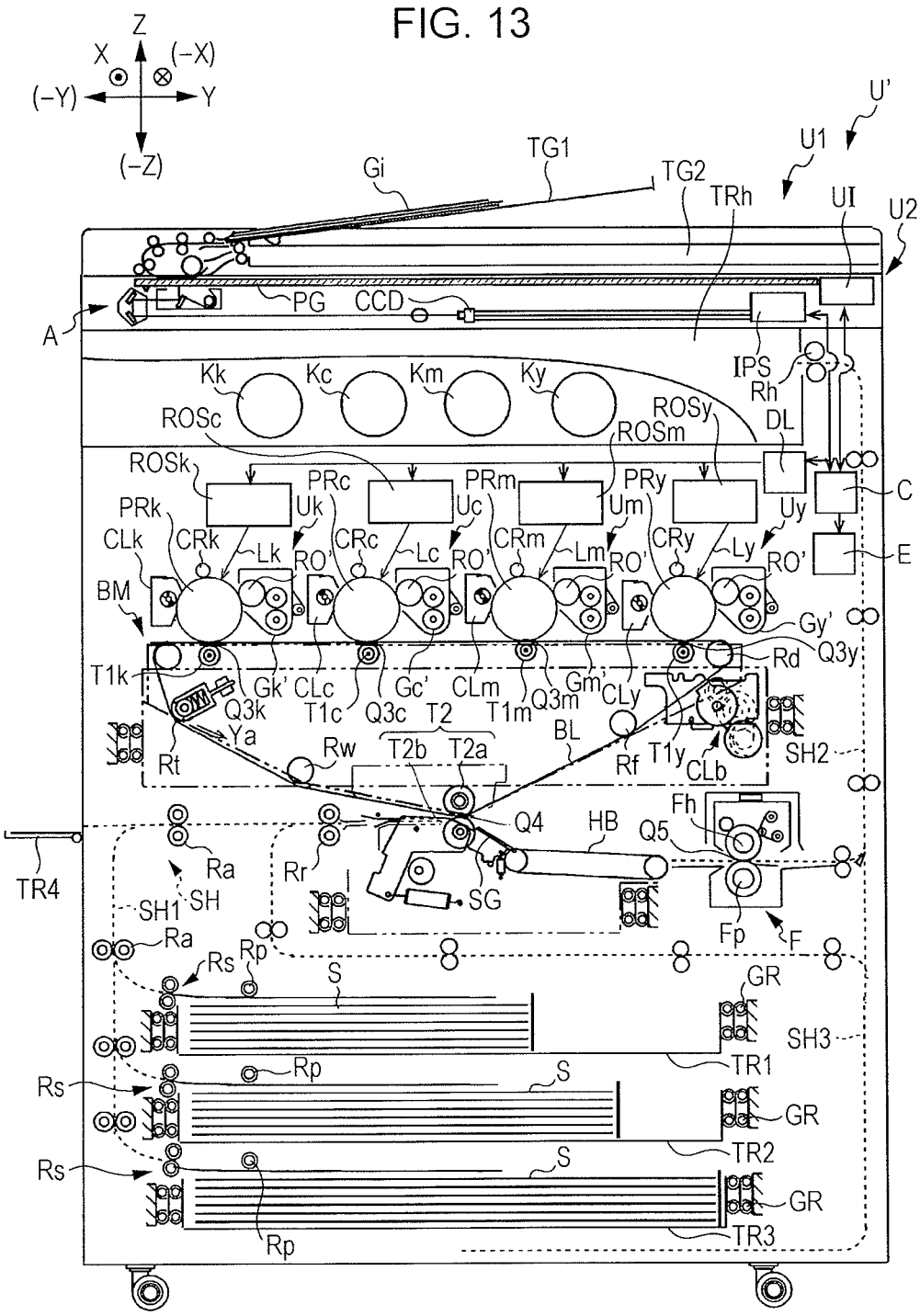
FIG. 13 is an explanatory overview of an image forming apparatus according to a third exemplary embodiment of the invention.

FIG. 13 is an explanatory overview of an image forming apparatus according to a third exemplary embodiment of the invention.

Next, a third exemplary embodiment of the present invention is described. Referring to FIG. 13, in a copier U' according to the third exemplary embodiment, like numerals refer like members, positions and shapes of which are different from those of members in the copier U according to the first exemplary embodiment but functions of which are similar to those of the members in the copier U according to the first exemplary embodiment, and the detailed description is omitted. The copier U' according to the third exemplary embodiment is a copier of related art. In the following description, only developing devices Gy' to Gk' according to the third exemplary embodiment are described, and the description of the other members is omitted.

Developing Devices Gy' to Gk'

Figure 14:
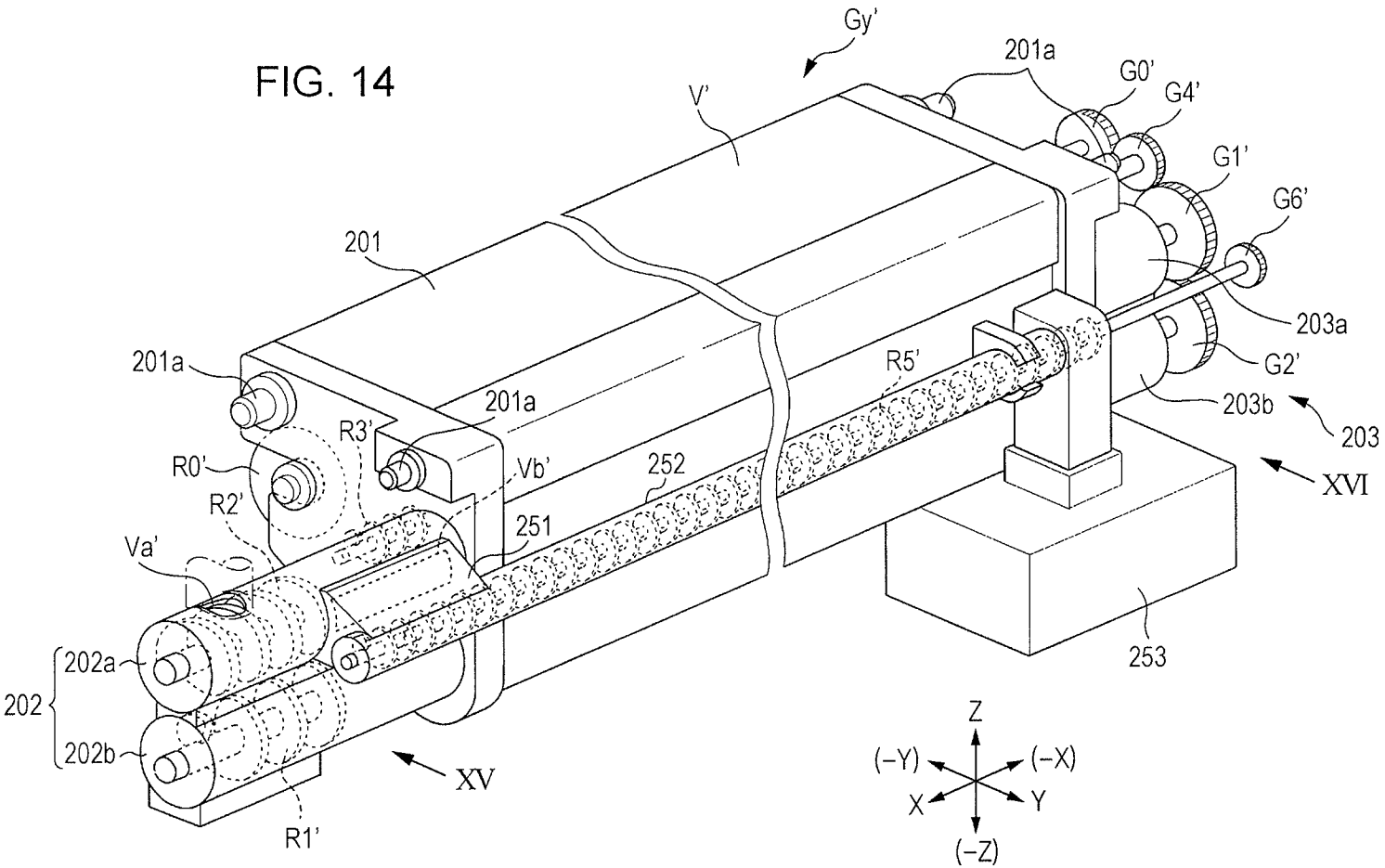
FIG. 14 is a perspective view of a developing device according to the third exemplary embodiment of the invention.

FIG. 14 is a perspective view of a developing device according to the third exemplary embodiment of the invention.

Figure 15:
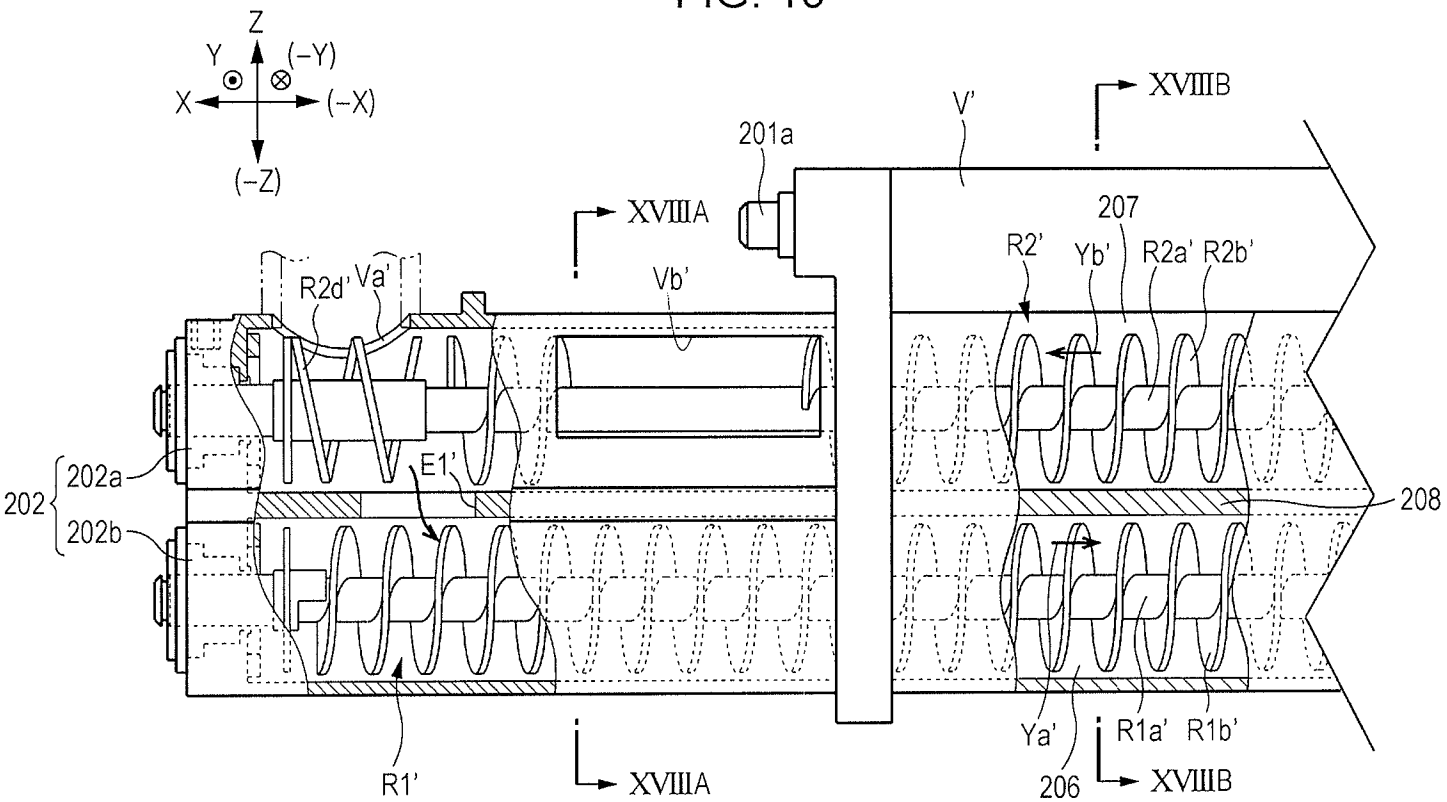
FIG. 15 is an enlarged explanatory view of an area near a supply port for a developer of the developing device according to the third exemplary embodiment of the invention, FIG. 15 being a fragmental sectional view when viewed in a direction indicated by arrow XV in FIG. 14.

FIG. 15 is an enlarged explanatory view of an area near a supply port for a developer of the developing device according to the third exemplary embodiment of the invention, FIG. 15 being a fragmental sectional view when viewed in a direction indicated by arrow XV in FIG. 14.

Figure 16:
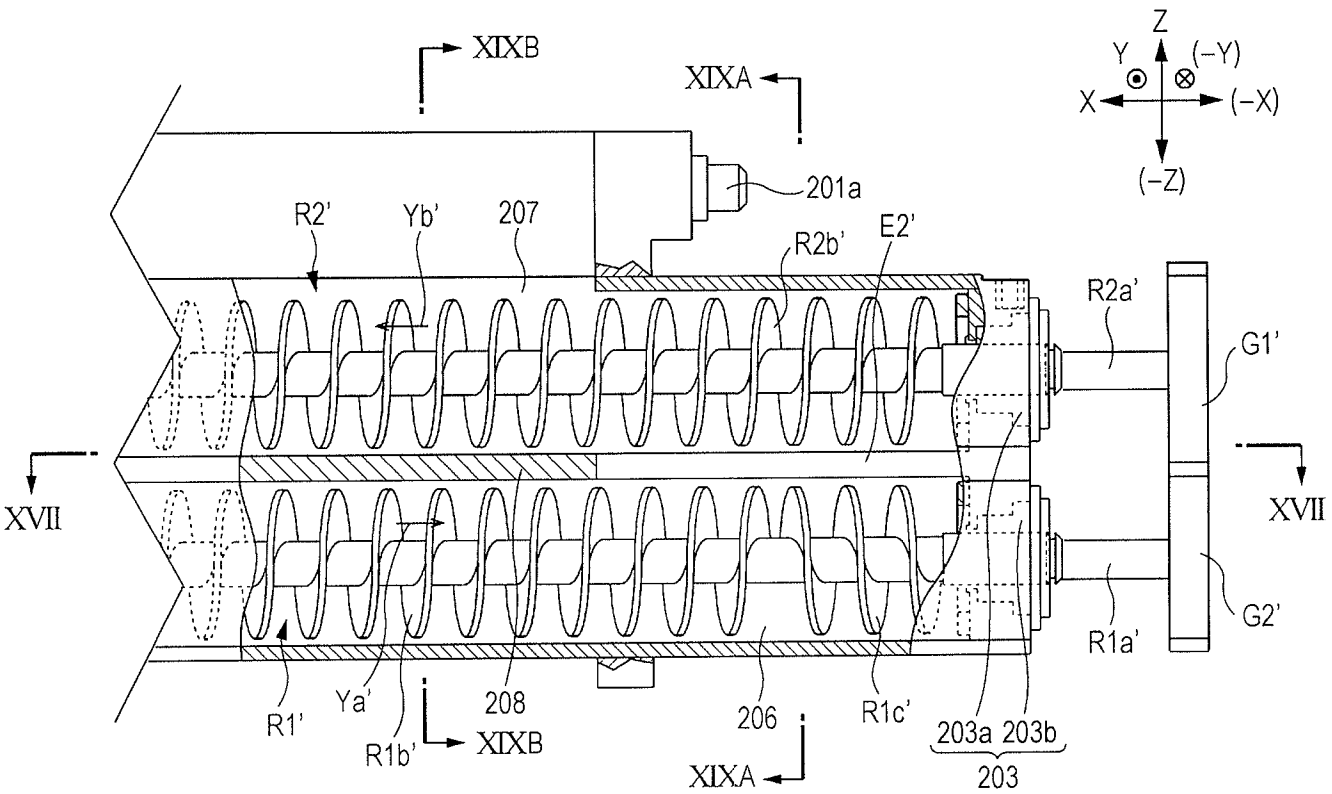
FIG. 16 is an explanatory view of a rear end portion of the developing device according to the third exemplary embodiment of the invention, FIG. 16 being a fragmentary sectional view when viewed in a direction indicated by arrow XVI in FIG. 14.

FIG. 16 is an explanatory view of a rear end portion of the developing device according to the third exemplary embodiment of the invention, FIG. 16 being a fragmentary sectional view when viewed in a direction indicated by arrow XVI in FIG. 14.

Figure 17:
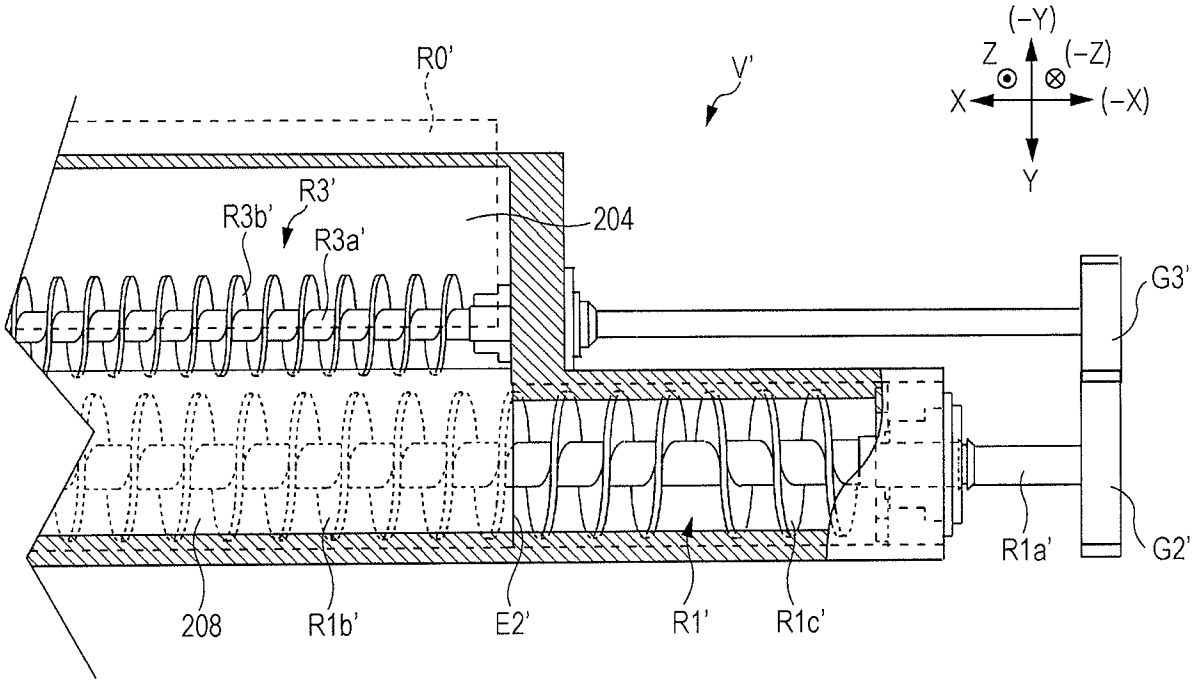
FIG. 17 is an explanatory view of the rear end portion of the developing device according to the third exemplary embodiment of the invention, FIG. 17 being an explanatory view of a cross section taken along line XVII-XVII in FIG. 16.

FIG. 17 is an explanatory view of the rear end portion of the developing device according to the third exemplary embodiment of the invention, FIG. 17 being an explanatory view of a cross section taken along line XVII-XVII in FIG. 16.

Figure 18A:
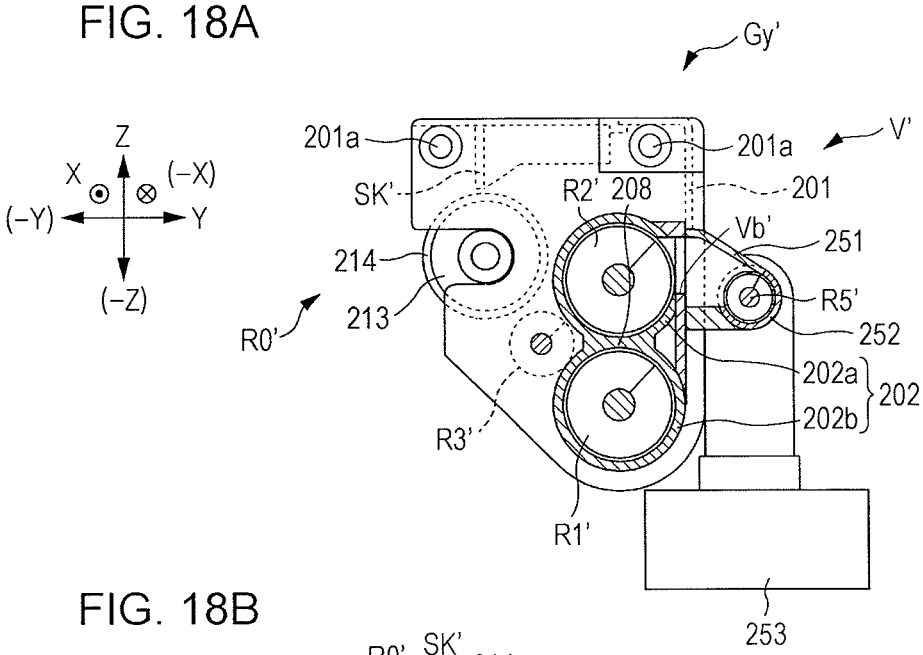
FIGS. 18A and 18B are explanatory views of the developing device according to the third exemplary embodiment of the invention, FIG. 18A being a cross-sectional view taken along line XVIIIA-XVIIIA in FIG. 15, FIG. 18B being a cross-sectional view taken along line XVIIIB-XVIIIB in FIG. 15.
Figure 18B:
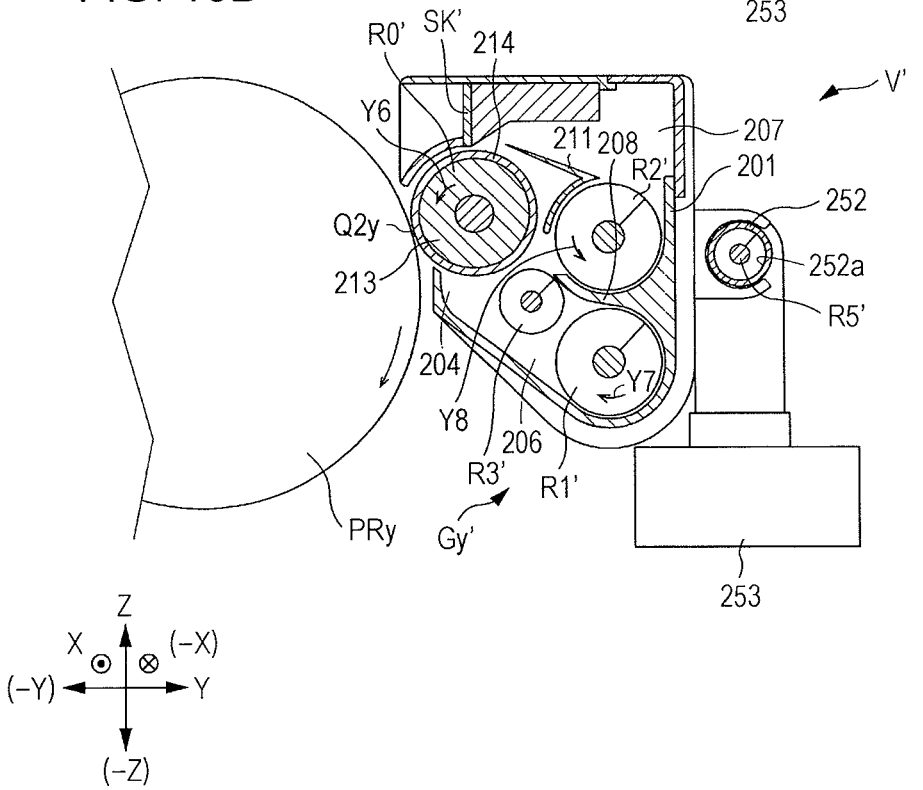

FIGS. 18A and 18B are explanatory views of the developing device according to the third exemplary embodiment of the invention, FIG. 18A being a cross-sectional view taken along line XVIIIA-XVIIIA in FIG. 15, FIG. 18B being a cross-sectional view taken along line XVIIIB-XVIIIB in FIG. 15.

Figure 19A:
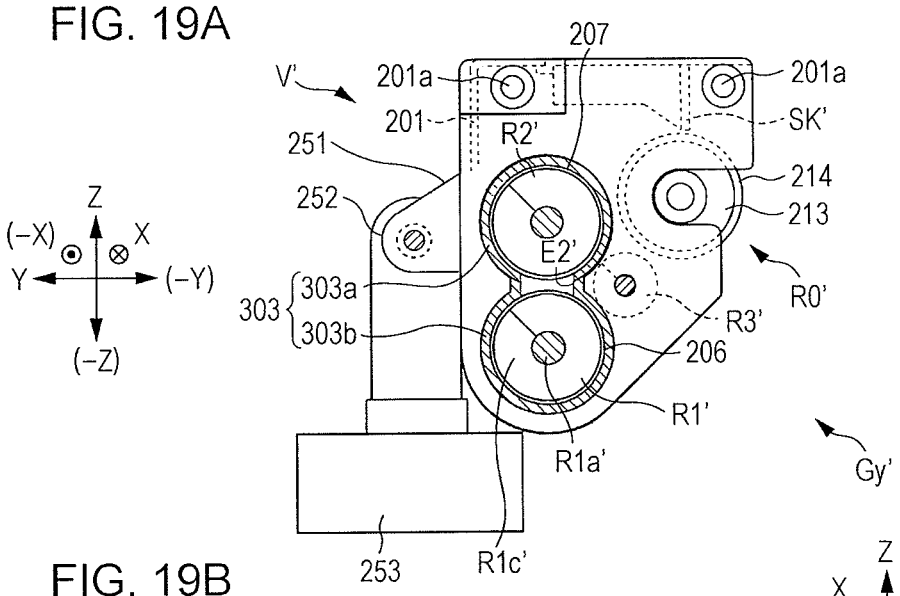
FIGS. 19A to 19C are explanatory views of the developing device according to the third exemplary embodiment of the invention, FIG. 19A being a cross-sectional view taken along line XIXA-XIXA in FIG. 16, FIG. 19B being a cross-sectional view taken along line XIXB-XIXB in FIG. 16, FIG. 19C being an explanatory view of gears of the developing device.
Figure 19B:
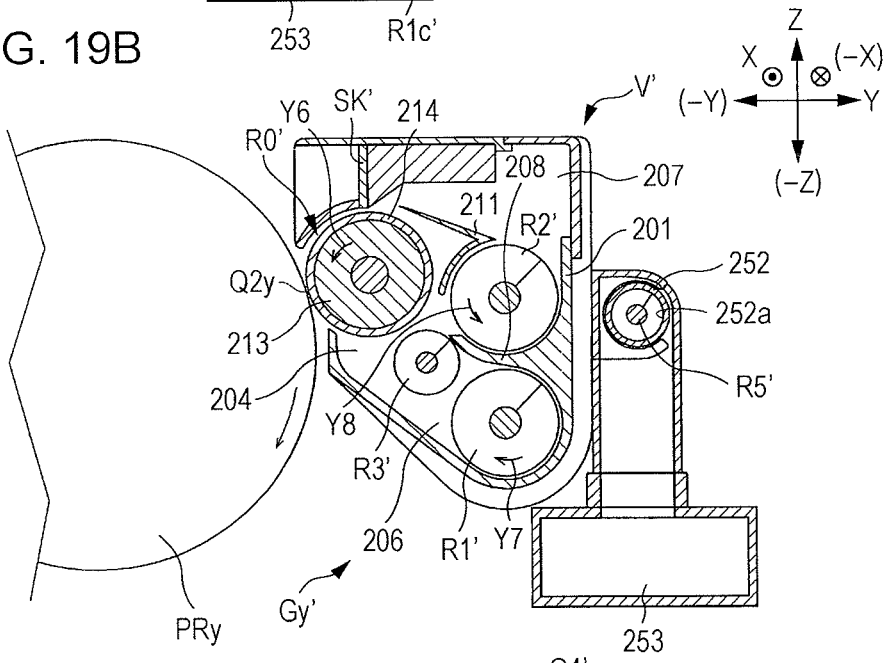
Figure 19C:
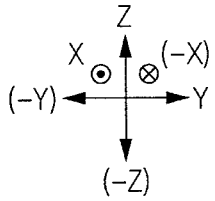
Figure 19C:
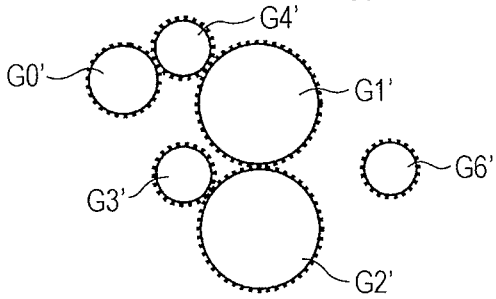

FIGS. 19A to 19C are explanatory views of the developing device according to the third exemplary embodiment of the invention, FIG. 19A being a cross-sectional view taken along line XIXA-XIXA in FIG. 16, FIG. 19B being a cross-sectional view taken along line XIXB-XIXB in FIG. 16, FIG. 19C being an explanatory view of gears of the developing device.

Referring to FIGS. 13 and 14, the copier U' according to the third exemplary embodiment includes developing devices Gy', Gm', Gc', and Gk' according to the third exemplary embodiment instead of the developing devices Gy, Gm, Gc, and Gk according to the first exemplary embodiment. The developing devices Gy' to Gk' according to the third exemplary embodiment are arranged at the right sides of the image holding bodies PRy to PRk arranged above the belt module BM. The developing devices Gy' to Gk' have similar configurations. Thus, only the developing device Gy' for Y color is described, and the developing devices Gm', Gc', and Gk' of the other colors are not described in detail.

Referring to FIGS. 18B and 19B, the developing device Gy' facing the image holding body PRy in the developing region Q2*y* includes a developer container V' that houses a developer.

Referring to FIG. 14, the developer container V' includes a container body 201, a front connection member 202 and a rear connection member 203 respectively coupled with a front end and a rear end of the container body 201. The front connection member 202 includes a front upper connection member 202*a* and a front lower connection member 202*b*. The rear connection member 203 includes a rear upper connection member 203*a* and a rear lower connection member 203*b*.

Referring to FIGS. 14 to 16, a pair of supported portions 201*a* are provided at an upper portion of each of the front end and the rear end of the container body 201. When the developer container V' is installed in the copier U', the supported portions 201*a* are supported by a frame (not shown) of the copier U'.

Referring to FIGS. 18B and 19B, the developer container V' including the container body 201, the front connection member 202 and the rear connection member 203 includes therein a developing roller chamber 204 as an example of a holding body housing chamber, a lower stirring chamber 206 arranged obliquely below the developing roller chamber 204, and an upper stirring chamber 207 being adjacent to the developing roller chamber 204 and arranged above the lower stirring chamber 206. A partition wall 208 partitions the lower stirring chamber 206 and the upper stirring chamber 207 from each other. Referring to FIG. 15, a front inflow portion E1' is formed at a front end portion of the partition wall 208. The front inflow portion E1' connects the lower stirring chamber 206 and the upper stirring chamber 207 in the vertical direction. Referring to FIGS. 16 and 19A, a rear inflow portion E2' is formed at a rear end portion of the partition wall 208. The rear inflow portion E2' connects the lower stirring chamber 206 and the upper stirring chamber 207 in the vertical direction. The lower stirring chamber 206 and the upper stirring chamber 207 form a circulation stirring chamber 206+207 according to the third exemplary embodiment.

Referring to FIGS. 18A to 19C, a developing roller R0' as an example of a developer holding body is housed in the developing roller chamber 204. The developing roller R0' includes a magnet roller 213 and a developing sleeve 214. The magnet roller 213 is an example of a magnet member, has plural magnetic poles on an outer peripheral surface thereof, and is fixed to and supported by the developer container V'. The developing sleeve 214 is an example of a cylindrical or substantially cylindrical member, is supported rotatably at the outer periphery of the magnet roller 213, and is rotated while holding the developer attracted by a magnetic force of the magnet roller 213 on the outer surface. The developing sleeve 214 according to the third exemplary embodiment is rotated in a direction indicated by arrow Y6 in which the surface of the developing sleeve 214 moves from the upper side to the lower side in the developing region Q2*y*.

A layer-thickness regulating member SK' according to the third exemplary embodiment is supported in the developer container V' at a position above the developing roller R0'. The layer-thickness regulating member SK' extends along the developing roller R0', faces the surface of the developing roller R0', and regulates the thickness of a layer of the developer held on the developing roller R0'.

Figure 20:
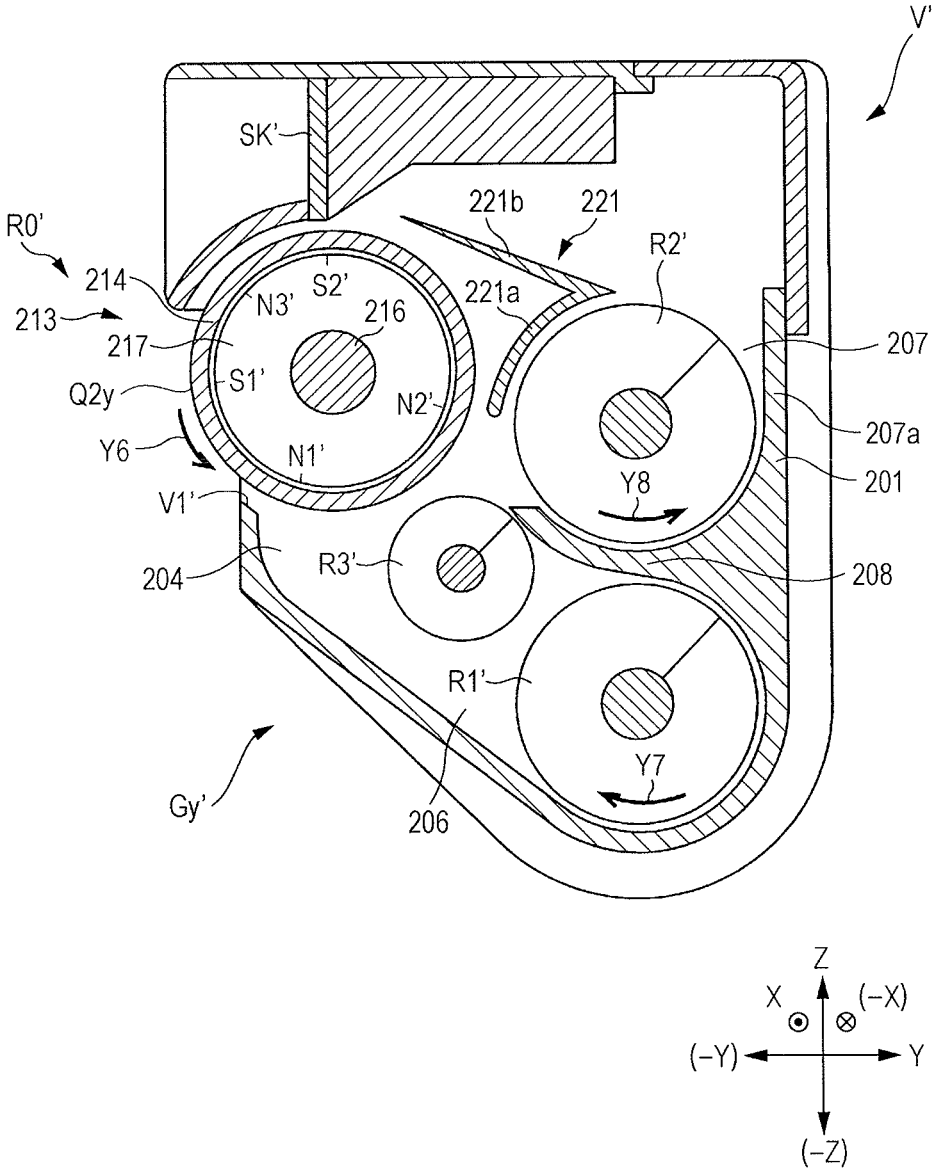
FIG. 20 is an explanatory view of the developing device according to the third exemplary embodiment of the invention, FIG. 20 being an enlarged view of a feature portion in FIG. 18B.

FIG. 20 is an explanatory view of the developing device according to the third exemplary embodiment of the invention, FIG. 20 being an enlarged view of a feature portion in FIG. 18B.

Referring to FIG. 20, the magnet roller 213 has a support shaft 216 extending in the front-rear direction. A magnet roller body 217 as an example of a magnet member body is fixed to and supported by the support shaft 216.

A developing magnetic pole S1' is arranged on an outer peripheral surface of the magnet roller body 217. The developing magnetic pole S1' faces the developing region Q2*y*, and causes the developer on the surface of the developing sleeve 214 to rise toward the image holding body PRy. A pickoff magnetic pole N1' is arranged downstream of the developing magnetic pole S1' in a rotation direction of the developing sleeve 214. The pickoff magnetic pole N1' is an example of a release magnetic pole and has a polarity different from a polarity of the developing magnetic pole S1'. The pickoff magnetic pole N1' causes the developer held on the outer surface of the developing sleeve 214 to be released from the developing sleeve 214. A pickup magnetic pole N2' is arranged downstream of the pickoff magnetic pole N1' in the rotation direction of the developing sleeve 214. The pickup magnetic pole N2' is an example of an attracting magnetic pole, has the same polarity as the polarity of the pickoff magnetic pole N1', is arranged to face the upper stirring chamber 207, and causes the developer in the upper stirring chamber 207 to be attracted to the outer surface of the developing sleeve 214.

A layer-thickness regulating magnetic pole S2' is arranged downstream of the pickup magnetic pole N2' in the rotation direction of the developing sleeve 214. The layer-thickness regulating magnetic pole S2' has a polarity different from the polarity of the pickup magnetic pole N2' and faces the layer-thickness regulating member SK'. The layer-thickness regulating magnetic pole S2' causes the developer on the surface of the developing sleeve 214 to rise, and allows the layer-thickness regulating member SK' to regulate the thickness of the layer of the developer. A transport magnetic pole N3' is arranged downstream of the layer-thickness regulating magnetic pole S2' in the rotation direction of the developing sleeve 214 and upstream of the developing magnetic pole S1' in the rotation direction of the developing sleeve 214. The transport magnetic pole N3' has a polarity different from the polarity of the layer-thickness regulating magnetic pole S2'.

The support shaft 216 and the magnet roller body 217 form the magnet roller 213 according to the third exemplary embodiment. The developing sleeve 214 is rotatably supported at the support shaft 216 of the magnet roller 213. The magnet roller 213 and the developing sleeve 214 form the developing roller R0' according to the third exemplary embodiment.

Referring to FIGS. 14 to 20, a first auger R1' as an example of a first transport member is rotatably supported in the lower stirring chamber 206.

The first auger R1' includes a rotating shaft R1*a*' that extends along the developing roller R0' and is rotatably supported by the developer container V'. A forward transport blade R1*b*' and a backward transport blade R1*c*' are supported on an outer peripheral surface of the rotating shaft R1*a*'. The forward transport blade R1*b*' is an example of a spiral or substantially spiral stirring blade and extends from the front side to the rear side of the rotating shaft R1*a*'. The backward transport blade R1*c*' is provided at the rear side of the rotating shaft R1*a*'. When the first auger R1' is rotated in a direction indicated by arrow Y7 in FIG. 18B, the forward transport blade R1*a*' transports the developer in the lower stirring chamber 206 in a first transport direction Ya' from the front side to the rear side while stirring the developer during the rotation. The backward transport blade R1*c*' transports the developer near a rear end of the lower stirring chamber 206 in a direction opposite to the first transport direction Ya' while stirring the developer during the rotation. The developer is transported from both front and rear sides by the forward transport blade R1*b*' and the backward transport blade R1*c*' and the developer is likely accumulated in a rear end portion of the lower stirring chamber 206. Hence, a configuration is provided such that the developer is allowed to flow from the lower stirring chamber 206 to the upper stirring chamber 207 through the rear inflow portion E2' provided above the rear end portion.

Referring to FIGS. 18A to 20, a second auger R2' as an example of a second transport member is rotatably supported in the upper stirring chamber 207. Referring to FIGS. 15 and 16, the second auger R2' includes a rotating shaft R2*a*' that extends along the developing roller R0' and is rotatably supported by the developer container V'. A second transport blade R2*b*' as an example of a spiral or substantially spiral transport blade of the second auger R2' is supported on an outer peripheral surface of the rotating shaft R2*a*'. When the second auger R2' is rotated in a direction indicated by arrow Y8 shown in FIG. 18B, the second transport blade R2*b*' transports the developer in the upper stirring chamber 207 in a second transport direction Yb' from the rear side to the front side while stirring the developer during the rotation. Referring to FIG. 15, a supply developer stirring member R2*d*' is provided at a front end portion of the second auger R2'. The supply developer stirring member R2*d*' stirs the developer supplied from a developer supply port Va' formed at an upper part of a front end portion of the upper connection member 202*a* and transports the developer to the front inflow portion E1'.

The first auger R1' and the second auger R2' form a circulation transport member R1'+R2'.

Referring to FIGS. 17 to 20, a third auger R3' as an example of a third transport member is arranged between the first auger R1' and the developing roller R0'. The third auger R3' includes a rotating shaft R3*a*' that extends along the developing roller R0' and is rotatably supported by the developer container V'. A third transport blade R3*b*' as an example of a spiral or substantially spiral transport blade of the third auger R3' is supported on an outer peripheral surface of the rotating shaft R3*a*'. The third transport blade R3*b*' transports the developer staying in a space between the developing roller R0' and the first auger R1' while stirring the developer.

Referring to FIGS. 14, 15, and 18A, a developer discharge port Vb' is formed at a side surface of the upper connection member 202*a*. The developer discharge port Vb' is formed at the upstream side of the developer supply port Va' in the second transport direction Yb', i.e., at the rear side, in order to reduce the amount of the developer discharged immediately after the developer is newly supplied from the developer supply port Va'.

Description of Interrupting Block 221

Figure 21A:
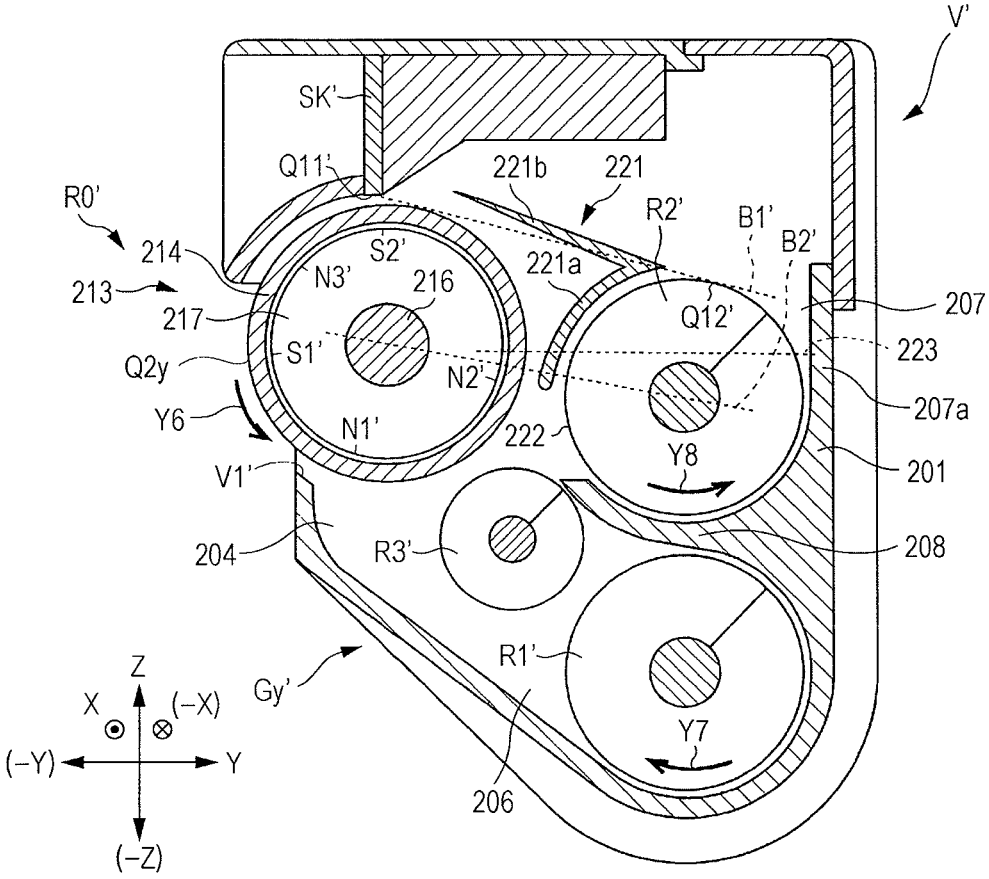
FIGS. 21A and 21B are explanatory views of an arrangement position of an interrupting member according to the third exemplary embodiment of the invention, FIG. 21A being an illustration corresponding to FIG. 20, FIG. 21B being an enlarged view of an area near a layer-thickness regulating member.
Figure 21B:
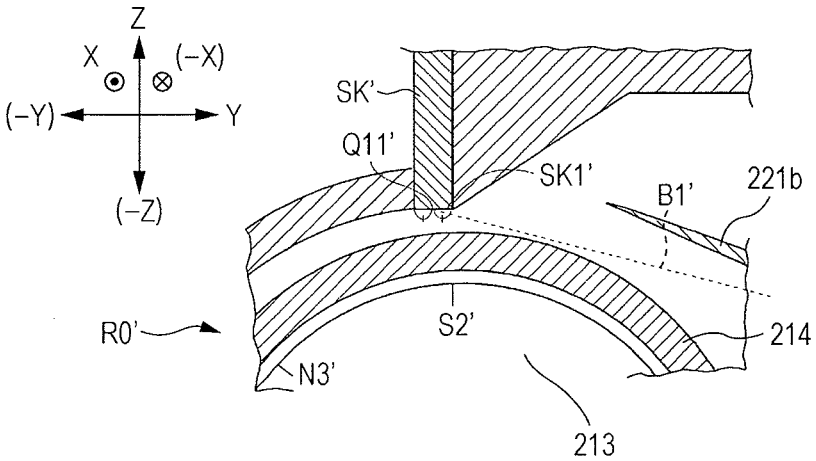

FIGS. 21A and 21B are explanatory views of an arrangement position of an interrupting member according to the third exemplary embodiment of the invention, FIG. 21A being an illustration corresponding to FIG. 20, FIG. 21B being an enlarged view of an area near a layer-thickness regulating member.

Referring to FIGS. 21A and 21B, an interrupting block 221 is arranged between the developing roller R0' and the second auger R2'. The interrupting block 221 is an example of an interrupting member, and interrupts movement of the developer that moves toward the developing roller R0'. The interrupting block 221 is supported by front and rear wall surfaces of the developer container V'. The interrupting block 221 includes an interrupting portion 221*a* and a guide portion 221*b*. The interrupting portion 221*a* has a shape of a partial cylinder curved along a rotation locus 222 of an outer edge in a radial direction of the second transport blade R2*b*'. The guide portion 221*b* extends from an upper end of the interrupting portion 221*a* toward a region in which the layer-thickness regulating member SK' regulates the thickness of the layer of the developer, and guides the developer regulated by the layer-thickness regulating member SK' to the upper stirring chamber 207.

The interrupting portion 221*a* of the interrupting block 221 intersects with a first virtual plane B1' and a second virtual plane B2'.

The second virtual plane B2' according to the third exemplary embodiment passes through a rotation center of the developing roller R0' and a rotation center of the first auger R1'.

Also, the first virtual plane B1' according to the third exemplary embodiment is adjacent to the rotation locus 222, and passes through a facing position Q11' at which the layer-thickness regulating member SK' faces the developing roller R0'. The first virtual plane B1' is adjacent to the rotation lotus 222 at a position Q12' at which a speed in a circumferential direction of the second transport blade R2*b*' has a speed component in a direction toward the layer-thickness regulating member SK'.

As shown in FIG. 21B, the facing position Q11' according to the third exemplary embodiment is on an end portion SK1' of the layer-thickness regulating member SK' facing the developing roller R0', in particular, the facing position Q11' is at a position at a center portion in the rotation direction of the developing sleeve 214. Like the first exemplary embodiment, the facing position Q11' may be a desirable position in a space in which the layer-thickness regulating member SK' faces the developing roller R0'.

In the third exemplary embodiment, a predetermined level of a developer when an image with a maximum printable toner consumption is continuously printed is determined as a lower-limit level 223 of the developer. In the third exemplary embodiment, if the image with the maximum printable toner consumption is continuously printed, a level of the developer being in contact with a right wall 207*a* of the upper stirring chamber 207 is determined to be higher than an arrangement position of the attracting magnetic pole N2'.

The container body 201, the front connection member 202, the rear connection member 203, the developing roller chamber 204, the lower stirring chamber 206, the upper stirring chamber 207, the partition wall 208, the interrupting block 221, etc., form the developer container V' according to the third exemplary embodiment.

Referring to FIGS. 14 and 19C, a gear G0' is mounted at a rear end portion of the developing sleeve 214 of the developing roller R0'. Gears G1', G2', and G3' are respectively mounted at rear end portions of the rotating shafts R2*a*', R1*a*', and R3*a*'. The gear G0' meshes with the gear G1' through an intermediate gear G4'. Also, the gears G1', G2', and G3' mesh with one another in that order. During developing operation, a rotational force of a drive source (not shown) is transmitted to the gears G0', G4', G1', G2', and G3' in that order, and the developing sleeve 214 of the developing roller R0', and the augers R1' to R3' are rotated.

Referring to FIGS. 14, and 19A and 19B, a connection portion 251 of a developer transport cylinder for discharge is arranged outside the developer discharge port Vb'. A front end portion of a developer transport cylinder 252 for discharge is connected with the connection portion 251 of the developer transport cylinder for discharge. A recovery tank 253 as an example of a recovery container for a discharged developer is connected with a rear end portion of the developer transport cylinder 252 for discharge. The inside of the developer transport cylinder 252 for discharge forms a developer discharge path 252*a*. Referring to FIG. 14, a developer transport member R5 for discharge is arranged in the developer transport cylinder 252 for discharge. The discharge of the developer is controlled in accordance with a detection value of an in-container toner density sensor (not shown).

Referring to FIGS. 14 and 19C, a gear G6' is mounted at a rear end portion of a rotating shaft of the developer transport member R5 for discharge. The gear G6' is rotated by a drive source for developer discharge (not shown). When the gear G6' is rotated, the developer transport member R5 for discharge is rotated, an excessive developer, which is discharged into the developer transport cylinder 252 for discharge from the developer discharge port Vb' through the connection portion 251 of the developer transport cylinder for discharge, is transported to the recovery tank 253.

The developer container V', the developing roller R0', the transport members R1' to R5', and the elements indicated by reference signs 251 to 253, etc., form the developing device Gy' according to the third exemplary embodiment.

Operation of Third Exemplary Embodiment

Figure 22:
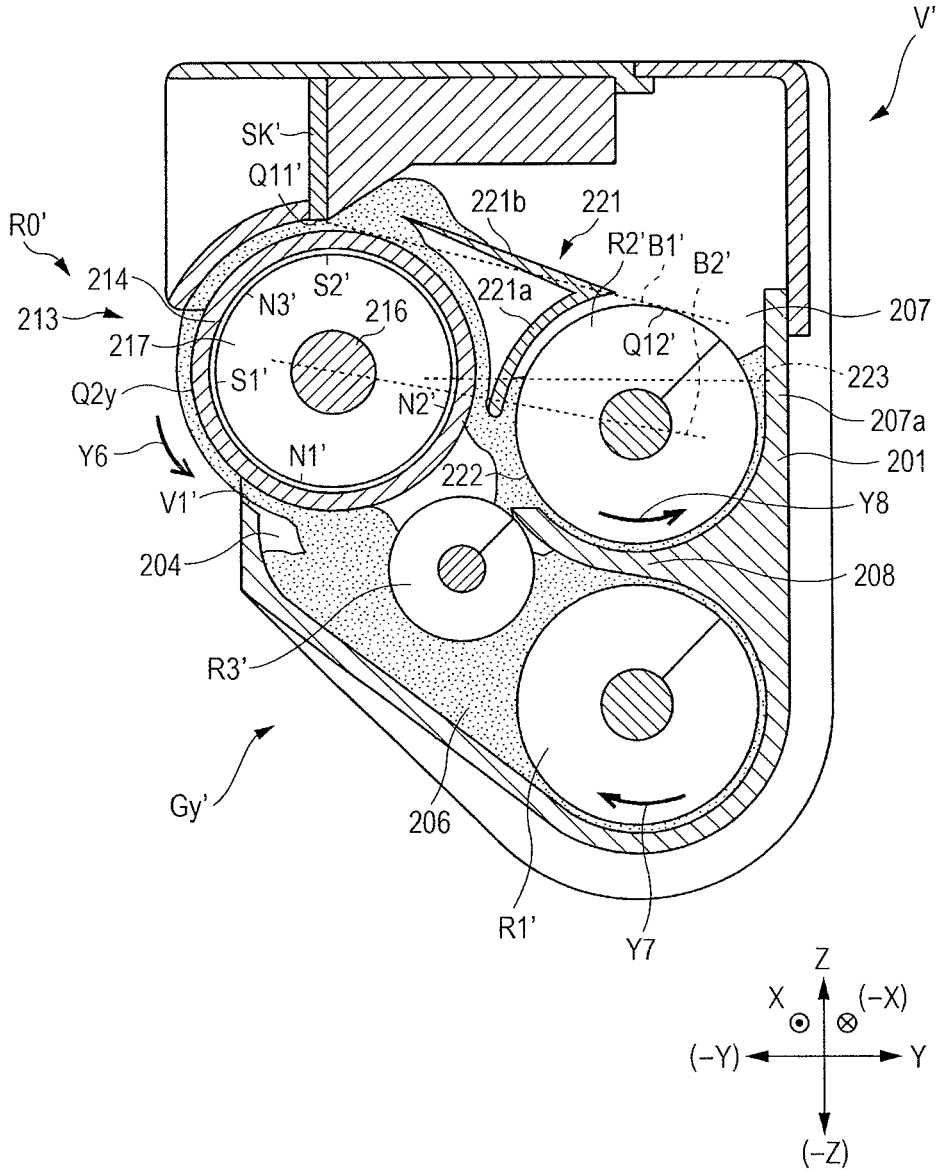
FIG. 22 is an operation explanatory view according to the third exemplary embodiment of the invention.

FIG. 22 is an operation explanatory view according to the third exemplary embodiment of the invention.

Referring to FIG. 22, in the copier U' according to the third exemplary embodiment including the above-described configuration, electrostatic latent images are formed on surfaces of the image holding bodies PRy to PRk, and the developing devices Gy' to Gk' develop the latent images on the image holding bodies PRy to PRk into toner images with the developers held on the developing rollers R0'.

In each of the developing devices Gy' to Gk' according to the third exemplary embodiment, the augers R1' to R3' including the spiral or substantially spiral transport blades R1*b'* to R3*b'* transport the developer housed in the circulation stirring chamber 206+207 while stirring the developer. Then, the developer transported to the upper stirring chamber 207 of the circulation stirring chamber 206+207 is attracted to the developing sleeve 214 of the developing roller R0' while being stirred by the second auger R2'. The developer attracted to the developing sleeve 214 is rotated and transported in a direction indicated by arrow Y6 while being held on the developing sleeve 214. The layer-thickness regulating member SK' regulates the thickness of the layer of the developer. Then, the developer is transported to each of the developing regions Q2*y* to Q2*k*.

In the third exemplary embodiment, the interrupting block 221 is arranged between the developing roller R0' and the second auger R2'. Hence, even if the developer is pulsed by the second transport blade R2*b'* in a radial direction and intends to move toward the developing roller R0', the developer is interrupted by the interrupting block 221. Accordingly, with the third exemplary embodiment, like the first exemplary embodiment, likelihood of occurrence of a phenomenon, in which a force is applied to the developer from the second auger R2' and the developer is held by the developing roller R0', is reduced, and the unevenness of the developer on the developing roller R0' is likely reduced.

Figure 23:
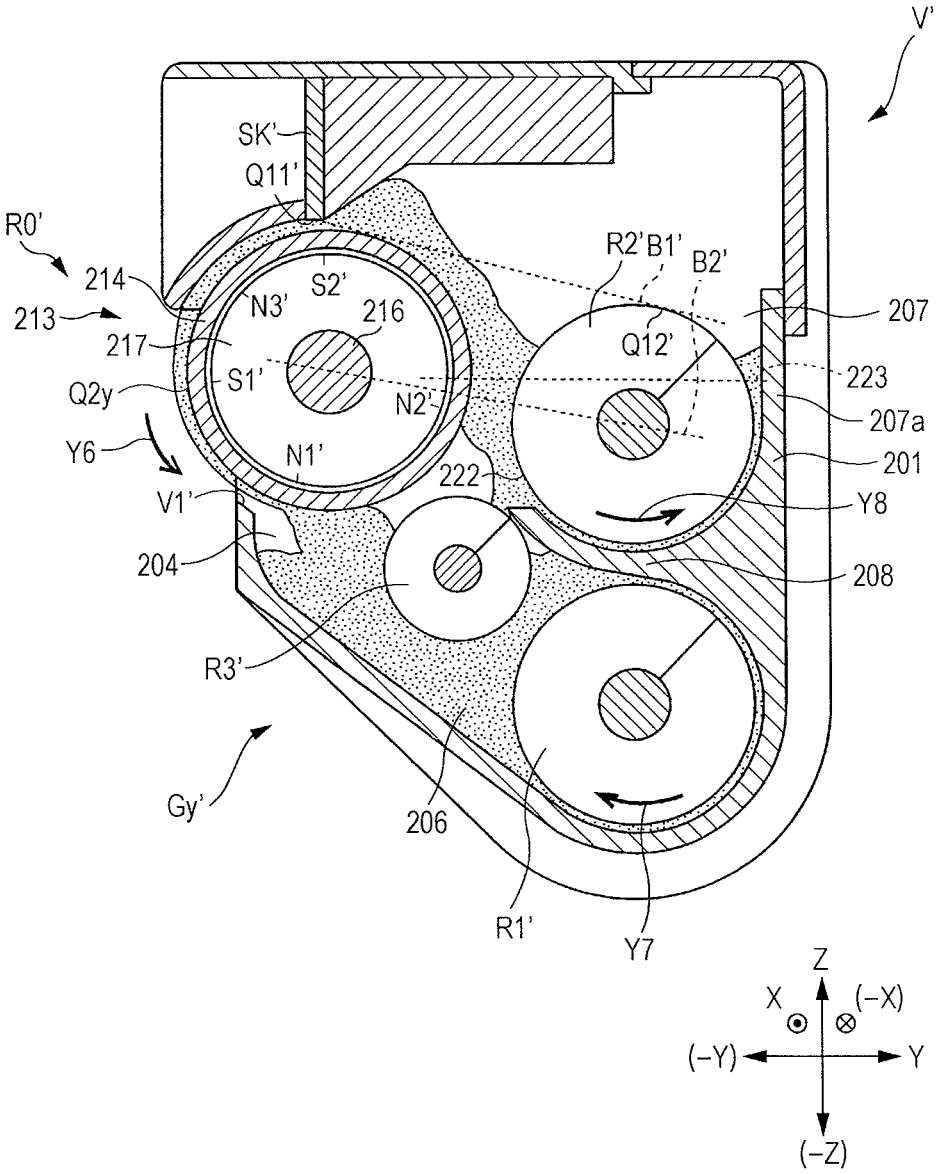
FIG. 23 is an explanatory view when a case, in which the interrupting member is not provided, is compared with the third exemplary embodiment.

FIG. 23 is an explanatory view when a case, in which the interrupting member is not provided, is compared with the third exemplary embodiment.

In each of the developing devices Gy' to Gk' according to the third exemplary embodiment, the layer-thickness regulating member SK' is arranged above the developing roller R0' in the gravity direction. The developer regulated by the layer-thickness regulating member SK' hardly moves downward in the gravity direction, and is likely accumulated at the upstream side of the layer-thickness regulating member SK'. Also, in the third exemplary embodiment, the lower-limit level 223 of the developer is determined to be higher than the arrangement position of the attracting magnetic pole N2'. The space between the developing roller R0' and the upper stirring chamber 207 is likely filled with the developer.

Hence, if the interrupting block 221 is not provided, as shown in FIG. 23, a portion of the developing roller R0' extending from a position at which the developer is attracted to the developing roller R0' to a position at which the thickness of the layer of the developer is regulated is filled with the developer supplied from the upper stirring chamber 207, and the portion is likely dipped in the developer. Owing to this, when the second auger R2' transports the developer, if the second transport blade R2*b'* pushes the developer, the force from the second transport blade R2*b'* is likely transmitted to the developing roller R0' through the developer.

In contrast, according to the third exemplary embodiment, since the interrupting block 221 intersects with the first virtual plane B1' and the second virtual plane B2', the interrupting block likely interrupts the force which is transmitted from the transport blade R2*b'* toward the developer roller R0' or the facing position Q11' through the developer. According to the third exemplary embodiment, the level of the developer is heightened as compared with the attracting magnetic pole N2'. Hence, likelihood of occurrence of insufficient attraction of the developer due to the wave-like bumps at the level of the developer depending on the transport blade R2*b'* is reduced. Also, likelihood of occurrence of the phenomenon, in which the developer is concentrated by the force transmitted from the transport blade R2*b'* and a part of an image corresponding to a portion of the developing roller with the concentrated developer is printed with a high density, is reduced.

The interrupting block 221 according to the third exemplary embodiment includes the guide portion 221*b*. The developer regulated by the layer-thickness regulating member SK' likely moves along the guide portion 221*b* and returns to the upper stirring chamber 207. Accordingly, likelihood of occurrence of the phenomenon, in which the developer regulated by the layer-thickness regulating member SK' flows to the space between the interrupting block 221 and the developing roller R0' from above and stays in the space, is reduced. Likelihood of occurrence in the deterioration of the developer is reduced.

Modifications

The exemplary embodiments of the present invention have been described above; however, the present invention is not limited to the exemplary embodiments, and may be modified within the scope of the present invention described in the claims. Modifications (H01) to (H06) of the invention are exemplarily described below.

(H01) In any of the above-described exemplary embodiments, the copier U or U' is used as an example of an image forming apparatus. However, it is not limited thereto. The image forming apparatus may be a multifunction apparatus including at least one of functions of facsimile and printing, in addition to the function of copying. Also, the image forming apparatus includes the image holding bodies PRy to PRk, the developing devices Gy to Gk or Gy' to Gk', and the latent image forming device ROS for four colors. However, it is not limited thereto. An image forming apparatus for a single color, or a rotary image forming apparatus, in which a single image holding body and a single latent-image forming device are provided and four developing devices are rotated and successively face the image holding body, may be applied.

(H02) In any of the exemplary embodiments, the portion of the interrupting member 11, 11', 11", or 211 facing the transport member R1 or R2' desirably has a shape that is curved along the rotation locus 12 or 222. However, it is not limited thereto. The portion of the interrupting member facing the transport member R1 or R2' may have any shape as long as the interrupting member has a configuration of interrupting the developer that directly moves from the transport member R1 or R2' to the developing roller R0 or R0', such as a configuration in which the portion of the interrupting member facing the transport member R1 or R2' has a flat plate-like shape.

(H03) In any of the exemplary embodiments, the upper end 11*a* of the interrupting member 11, 11', or 11" is desirably arranged below the lower-limit level 13 of the developer. However, it is not limited thereto. The upper end 11*a* may be arranged above the lower-limit level 13.

(H04) In the third exemplary embodiment, the guide portion 221*b* and the interrupting portion 221*a* are integrally formed. However, the guide portion 221*b* and the interrupting portion 221*a* may be formed of different members. Also, the guide portion 221*b* and the interrupting portion 221*a* formed of the different members may be arranged separately from each other. In the third exemplary embodiment, the guide portion 221*b* is desirably provided. However, the guide portion 221*b* may be omitted.

(H05) In any of the exemplary embodiments, the interrupting member 11, 11", or 211 desirably intersects with the second virtual plane B2 or B2'. However, the interrupting member 11, 11", or 211 may not intersect with the second virtual plane B2 or B2'. Also, in any of the exemplary embodiments, the interrupting member 11, 11', or 11" intersects with the third virtual plane B3. However, the interrupting member 11, 11', or 11" may not intersect with the third virtual plane B3.

(H06) In any of the exemplary embodiments, the single interrupting member 11, 11', 11", or 211 is arranged between the developing roller R0 or R0' and the auger R1 or R2'. However, it is not limited thereto. For example, plural interrupting members may be arranged in a direction from the auger R1 or R2' to the developing roller R0 or R0' with intervals, so that multilayered interrupting members interrupt the movement of the developer in plural steps, the developer which moves when receiving the force from the auger R1 or R2'.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer container that houses a developer;

a developer holding body that is supported by the developer container and includes a magnet member including a plurality of magnetic poles on an outer peripheral surface of the magnet member, and a substantially cylindrical member that is provided outside the magnet member and rotates while holding the developer on an outer surface of the substantially cylindrical member, the developer being attracted by a magnetic force of the magnet member;

a transport member that transports the developer while stirring the developer and includes a rotating shaft extending along the developer holding body, and a substantially spiral transport blade supported by the rotating shaft;

a layer-thickness regulating member that faces the developer holding body and regulates a thickness of a layer of the developer held on the developer holding body;

the magnet member including an attracting magnetic pole that causes the developer transported by the transport member to be attracted to the developer holding body; and an interrupting member that is arranged between the developer holding body and the transport member and interrupts movement of the developer, the interrupting member intersecting with a first virtual plane and a second virtual plane, the first virtual plane being adjacent to a rotation locus of an outer edge in a radial direction of the transport blade, the first virtual plane passing through a facing position at which the layer-thickness regulating member faces the developer holding body, the first virtual plane being adjacent to the rotation locus at a position at which a speed in a circumferential direction of the transport blade has a speed component in a direction toward the layer-thickness regulating member, the second virtual plane passing through a rotation center of the developer holding body and a rotation center of the transport member, the interrupting member interrupting the movement of the developer that is pushed in the radial direction of the transport blade when the developer is transported by the transport member and that moves toward the developer holding body, wherein the interrupting member and the transport member overlap in a gravity direction, and the interrupting member is disposed above the transport member in the gravity direction.

2. The developing device according to claim 1, wherein the interrupting member is curved along the rotation locus of the transport member.

3. The developing device according to claim 1, wherein the interrupting member has an upper end that is arranged below a predetermined lower-limit level of the developer in a gravity direction, the developer which is transported by the transport member.

4. An image forming apparatus comprising:

an image holding body that holds an image on a surface of the image holding body;

the developing device according to claim 1 that develops a latent image held on the surface of the image holding body into a visible image;

a transfer device that transfers the visible image on a medium; and a fixing device that fixes the visible image transferred on the medium to the medium.

5. The developing device according to claim 1, wherein the interrupting member is disposed such that there is a first gap above and a second gap below the interrupting member through which the developer from the transport blade flows.

6. A developing device comprising:

a developer container that houses a developer;

a developer holding body that is supported by the developer container and includes a magnet member including a plurality of magnetic poles on an outer peripheral surface of the magnet member, and a substantially cylindrical member that is provided outside the magnet member and rotates while holding the developer on an outer surface of the substantially cylindrical member, the developer being attracted by a magnetic force of the magnet member;

a transport member that transports the developer while stirring the developer and includes a rotating shaft extending along the developer holding body, and a substantially spiral transport blade supported by the rotating shaft;

a layer-thickness regulating member that faces the developer holding body and regulates a thickness of a layer of the developer held on the developer holding body;

the magnet member including an attracting magnetic pole that causes the developer transported by the transport member to be attracted to the developer holding body; and an interrupting member that is arranged between the developer holding body and the transport member and interrupts movement of the developer, the interrupting member having an upper end that is arranged below a predetermined lower-limit level of the developer in a gravity direction, the developer which is transported by the transport member, the interrupting member intersecting with a first virtual plane, the first virtual plane being adjacent to a rotation locus of an outer edge in a radial direction of the transport blade, the first virtual plane passing through a facing position at which the layer-thickness regulating member faces the developer holding body, the first virtual plane being adjacent to the rotation locus at a position at which a speed in a circumferential direction of the transport blade has a speed component in a direction toward the layer-thickness regulating member, the interrupting member interrupting the movement of the developer that is pushed in the radial direction of the transport blade when the developer is transported by the transport member and that moves toward the developer holding body.

7. A developing device comprising:

a developer container that houses a developer;

a developer holding body that is supported by the developer container and includes a magnet member including a plurality of magnetic poles on an outer peripheral surface of the magnet member, and a substantially cylindrical member that is provided outside the magnet member and rotates while holding the developer on an outer surface of the substantially cylindrical member, the developer being attracted by a magnetic force of the magnet member;

a transport member that transports the developer while stirring the developer and includes a rotating shaft extending along the developer holding body, and a substantially spiral transport blade supported by the rotating shaft;

a layer-thickness regulating member that faces the developer holding body and regulates a thickness of a layer of the developer held on the developer holding body;

the magnet member including an attracting magnetic pole that causes the developer transported by the transport member to be attracted to the developer holding body; and an interrupting member that is curved along a rotation locus of an outer edge in a radiation direction of the transport blade, is arranged between the developer holding body and the transport member, and interrupts movement of the developer, the interrupting member intersecting with a first virtual plane, the first virtual plane being adjacent to the rotation locus, the first virtual plane passing through a facing position at which the layer-thickness regulating member faces the developer holding body, the first virtual plane being adjacent to the rotation locus at a position at which a speed in a circumferential direction of the transport blade has a speed component in a direction toward the layer-thickness regulating member, the interrupting member interrupting the movement of the developer that is pushed in the radial direction of the transport blade when the developer is transported by the transport member and that moves toward the developer holding body, wherein the interrupt member and the transport member overlap in a gravity direction, and the interrupting member is disposed above the transport member in the gravity direction.

* * * * *